US009939197B2

(12) United States Patent
Hoffman

(10) Patent No.: US 9,939,197 B2
(45) Date of Patent: Apr. 10, 2018

(54) TURBULENT VACUUM THERMAL SEPARATION METHODS AND SYSTEMS

(71) Applicant: CALAERIS ENERGY & ENVIRONMENT LTD., Vancouver (CA)

(72) Inventor: Barry Hoffman, Wilcox (CA)

(73) Assignee: CALAERIS ENERGY + ENVIRONMENT LTD., Vancouver, BC (CA)

( * ) Notice: Subject to any disclaimer, the term of this patent is extended or adjusted under 35 U.S.C. 154(b) by 178 days.

(21) Appl. No.: 14/759,807

(22) PCT Filed: Jan. 24, 2014

(86) PCT No.: PCT/CA2014/050052
§ 371 (c)(1),
(2) Date: Jul. 8, 2015

(87) PCT Pub. No.: WO2014/113894
PCT Pub. Date: Jul. 31, 2014

(65) Prior Publication Data

US 2015/0338162 A1 Nov. 26, 2015

Related U.S. Application Data

(60) Provisional application No. 61/756,925, filed on Jan. 25, 2013.

(51) Int. Cl.
*F26B 3/02* (2006.01)
*F26B 5/04* (2006.01)
(Continued)

(52) U.S. Cl.
CPC ..... *F26B 3/02* (2013.01); *C10G 1/045* (2013.01); *C10G 31/00* (2013.01); *C10G 31/06* (2013.01);
(Continued)

(58) Field of Classification Search
CPC ..... F26B 15/26; F26B 17/18; F26B 23/02; F26B 5/04; F26B 11/049; F26B 5/041;
(Continued)

(56) References Cited

U.S. PATENT DOCUMENTS 2,431,274 A 11/1947 Osborne
2,615,199 A 10/1952 Fuller
(Continued)

FOREIGN PATENT DOCUMENTS

AU 2014210348 B2 6/2017
CA 1144497 4/1983
(Continued)

OTHER PUBLICATIONS

European Patent Office; Extended European search report for EP 14743718.0; dated Jul. 27, 2016; 12 pages; Munich, Germany.
(Continued)

*Primary Examiner* — Jessica Yuen
(74) *Attorney, Agent, or Firm* — Jeffrey L. Wendt; The Wendt Firm, P.C.

(57) ABSTRACT

Feeding a slurry comprising inert solids, liquid hydrocarbons, liquid water and sometimes dissolves solids to a unit having a casing defining a thermal extraction chamber heated both directly and indirectly in which first and second intermeshing screws rotate, the screws in close tolerance with each other and with inside casing surfaces. The casing and screws define a tortuous flow path in which the slurry and a vaporous composition evolved therefrom flow. The intermeshing screws push the slurry toward a discharge end of the chamber at a first velocity while reducing pressure and increasing temperature in the chamber, while rotating the screws to create turbulent vacuum thermal conditions in the chamber to physically transform some or all of the slurry into the vaporous composition. The vaporous composition
(Continued)

traverses the tortuous flow path with a second velocity at least 1.5 times the first velocity, optionally forming a heated, substantially dry, composition comprising the inert solids.

29 Claims, 21 Drawing Sheets

(51) Int. Cl.

| | |
|---|---|
| ***F26B 17/20*** | (2006.01) |
| ***C10G 31/00*** | (2006.01) |
| ***C10G 1/04*** | (2006.01) |
| ***C10G 31/06*** | (2006.01) |
| ***C10G 33/00*** | (2006.01) |

(52) U.S. Cl.
CPC ..... *C10G 33/00* (2013.01); *F26B 5/041* (2013.01); *F26B 17/20* (2013.01)

(58) Field of Classification Search
CPC ... F26B 17/20; F26B 3/02; B09C 1/00; B09C 1/06; B65G 53/48; B65G 53/60; B65G 53/24; B65G 53/26; C10G 31/00; C10G 1/045; C10G 31/06; C10G 33/00
USPC ..... 34/401, 406, 92, 147, 179, 112; 406/53, 406/54, 55, 56, 57, 58, 59, 60, 61; 366/163.2
See application file for complete search history.

(56) References Cited

U.S. PATENT DOCUMENTS

| | | | | |
|---|---|---|---|---|
| 2,659,761 | A | 11/1953 | Frevel et al. | |
| 2,980,600 | A | 4/1961 | Kelley | |
| 3,271,293 | A | 9/1966 | Clark | |
| 3,401,110 | A | 9/1968 | Floyd et al. | |
| 3,451,462 | A | 6/1969 | Szabo et al. | |
| 3,522,168 | A | 7/1970 | Bichard et al. | |
| 3,565,785 | A | 2/1971 | Cymbalisty | |
| 3,605,975 | A | 9/1971 | Brimhall | |
| 3,607,720 | A | 9/1971 | Paulsen | |
| 3,630,689 | A | 12/1971 | Wheeler et al. | |
| 3,773,740 | A | 11/1973 | Szabo | |
| 3,875,046 | A | 4/1975 | Rosenbloom | |
| 4,136,251 | A | 1/1979 | Bice et al. | |
| 4,210,491 | A | 7/1980 | Schulman | |
| 4,324,652 | A | 4/1982 | Hack | |
| 4,809,519 | A | 3/1989 | Cheng et al. | |
| 4,978,369 | A * | 12/1990 | Pontow | B01J 3/02 201/35 |
| 5,027,721 | A | 7/1991 | Anderson | |
| 5,111,756 | A | 5/1992 | Anderson | |
| 5,151,026 | A | 9/1992 | Andersen et al. | |
| 5,242,245 | A | 9/1993 | Schellstede | |
| 5,269,821 | A | 12/1993 | Helmin et al. | |
| 5,514,286 | A | 5/1996 | Crosby | |
| 5,698,666 | A | 12/1997 | Burroway et al. | |
| 5,882,381 | A | 3/1999 | Hauck et al. | |
| 6,244,197 | B1 | 6/2001 | Coble | |
| 6,399,851 | B1 * | 6/2002 | Siddle | C22B 7/001 110/295 |
| 6,464,430 | B1 | 10/2002 | Malek | |
| 6,745,818 | B1 | 6/2004 | Fan et al. | |
| 6,840,712 | B2 | 1/2005 | Satchwell et al. | |
| 7,396,433 | B2 | 7/2008 | Strand | |
| 7,591,929 | B2 | 9/2009 | Strand | |
| 7,691,259 | B2 | 4/2010 | Freeman et al. | |
| 7,727,384 | B2 | 6/2010 | Strand | |
| 7,727,396 | B1 * | 6/2010 | Hansen | C02F 3/2846 210/603 |
| 7,960,491 | B2 | 6/2011 | Lovegrove et al. | |
| 8,110,095 | B2 | 2/2012 | Strand | |
| 8,181,790 | B2 | 5/2012 | Ishida et al. | |
| 8,220,178 | B2 | 7/2012 | Schellstede | |
| 8,268,165 | B2 | 9/2012 | Yeggy et al. | |
| 8,585,891 | B2 * | 11/2013 | Lourenco | C10G 1/002 208/390 |
| 2004/0089437 | A1 | 5/2004 | Fan et al. | |
| 2007/0131590 | A1 | 6/2007 | Bozak et al. | |
| 2008/0139700 | A1 | 6/2008 | Roden et al. | |
| 2010/0085831 | A1 | 4/2010 | Sturm et al. | |
| 2010/0167912 | A1 | 7/2010 | Odueyungbo | |
| 2010/0313839 | A1 | 12/2010 | Pocknell | |
| 2012/0260808 | A1 | 10/2012 | Thomas | |
| 2014/0363234 | A1 | 12/2014 | Hamilton | |
| 2015/0197707 | A1 | 7/2015 | Redford | |

FOREIGN PATENT DOCUMENTS

| | | | |
|---|---|---|---|
| CA | 1144497 | A | 4/1983 |
| CA | 1239105 | | 7/1988 |
| CA | 1239105 | A | 7/1998 |
| CA | 2897875 | C | 12/2015 |
| CN | 201198189 | Y | 2/2009 |
| DE | 10324625 | A1 | 7/2004 |
| JP | 3051115 | A | 3/1991 |
| JP | 2009263535 | A | 11/2009 |
| JP | 2011133212 | A | 7/2011 |
| WO | 2014113894 | A1 | 7/2014 |

OTHER PUBLICATIONS

Examination Report No. 1, IP Australia, dated Apr. 6, 2017, 4 pages.
Notice of Acceptance, IP Australia, dated Jun. 13, 2017, 3 pages.
Examiner Requisition, Canadian Intellectual Property Office, dated Aug. 11, 2015, 3 pages.
Notice of Allowance, Canadian Intellectual Property Office, dated Sep. 10, 2015, 1 page.
Canadian Intellectual Property Office; Examiner Requisition for CA 2897875; dated Aug. 11, 2015 and response filed thereto Aug. 26, 2015; (6 pages).
Canadian International Searching Authority; International Search Report & Written Opinion for PCT/CA2014/050052; dated Apr. 14, 2014; Quebec, CA.
Chinese Patent Office; Office Action issued for corresponding Chinese Application No. 201480006075.9 dated Mar. 21, 2016; 7 pages; Beijing, CN.
Penn State Univ., "Residence Time", p. 1-10, downloaded from the Internet at url zeus.plmsc.psu.edu/~manias/MatSE447/22_ResidenceTime.pdf, created Nov. 20, 2005, modified Nov. 17, 2009.

* cited by examiner

D1-SCREW DIAMETER
D2-INSIDE DIAMETER OF THERMAL EXTRACTION BARREL
Dg-DISTANCE BETWEEN INTERMESHING SCREWS

TYPE A OIL BASE SLURRY

TYPE B OIL BASE SLURRY

TYPE C OIL BASE SLURRY

CYCLONE DIMENSIONS (IN METERS)

| | | |
|---|---|---|
| DIA | D | 0.11 |
| INLET HT | a | 0.05 |
| INLET WIDTH | b | 0.02 |
| OUTLET LENGTH | S | 0.05 |
| OUTLET DIA | De | 0.05 |
| CYLINDER HT | h | 0.16 |
| OVERALL HT | H | 0.43 |
| DUST OUTLET DIA | B | 0.04 |

TURBULENT VACUUM THERMAL SEPARATION METHODS AND SYSTEMS

TECHNICAL FIELD

The present disclosure relates generally to the field of fluid/solid separation methods and systems, and more specifically to turbulent vacuum thermal separation methods and systems for separating solids from various compositions comprising oil, water, and solids.

BACKGROUND ART

Many industries generate oil-based slurries. An oil-based slurry (OBS) composition may be a homogenized, viscous and stable semi-solid composition containing oil, water (usually emulsified) and fine solids. The solids fraction may be inert inorganic material such as clays, salts and minerals. Especially problematic are OBS compositions in which the largest solid particles are less than 10 micrometers in diameter, rendering most mechanical equipment such as centrifuges and presses impractical. Many OBS compositions are considered waste byproducts today, where further extraction of hydrocarbons is no longer practical. Hydrocarbon content in waste OBS compositions can range from about 5 percent to about 90 percent (weight basis is used herein unless otherwise noted) of the OBS composition, therefore making many OBS compositions ideal for further processing to extract valuable hydrocarbons for recovery and recycling. Traditional methods such as thermal desorption, incineration, chemical treatment, deep well injection, solidification and landfill disposal may either be very costly, require significant energy, use hazardous chemicals, have poor recovery efficiencies, generate low quality hydrocarbons, alter the original hydrocarbons, use chemicals that may negatively impact the environment or provide no recovery of valuable hydrocarbons in the waste OBS composition.

Where mechanical separation can be applied to OBS compositions, typically two or three separated components are generated where at least one component is a non-liquid containing solid with some quantity of the residual liquids. This semi-solid has the physical characteristics of sludge. Sludge is a heavy, viscous semi-solid material that contains similar components of slurry but with higher solids content. Sludge is generated from numerous sources, such as: oil refining; mud brought up by a mining drill; precipitate in a sewage tank; sediment in a steam boiler or crankcase, and other sources.

Current technologies for treating or disposing of slurries and/or sludges include the following. As used herein the term "oil" includes, but is not limited to, hydrocarbon oils.

Water and Solids Slurries and Sludges. For most slurries and sludges containing only water and solids, the objective is to maximize volume reduction which may be accomplished using traditional equipment such as simple settling basins, clarifiers, filter presses, belt presses, centrifuges, and the like. However, where the solids are fine (less than about 10 micrometers in diameter, and especially less than 1 micrometer), coagulants and/or flocculants may be required with these technologies to effectively increase the size of the solids so that settling using gravitation force or centrifugal force can generate a byproduct with as little water as possible. In addition, all of these technologies generate a byproduct (cake) with some water ranging from about 40 percent to about 80 percent, therefore if the objective is to remove 100 percent of the water, then the water must be evaporated using a thermal process typically known as sludge drying. Alternatively, if the cake can pass landfill acceptance criteria (typically a paint filter test or slump test and leachate criteria) the cake may be suitable for disposal in a landfill. When the feed slurry or sludge contains fine solids that cannot be agglomerated using coagulants and flocculants, then the feed must be dried directly using a thermal process without traditional equipment, and without the benefit of pre-treatment. In this case, significant water will remain in feed material and removal of the water through evaporation will require a significant amount of energy using sludge dryers. In many cases, a high water content slurry or sludge does not pass the landfill acceptance criteria.

Oil, Water and Solids Slurries and Sludges. When the slurry or sludge contains oil, water and solids, processing may be more complex. Processing objectives may be several, such as recovery of oil, recovery of solids (such as catalyst fines or metals), maximum volume reduction, or some combination of these. Complexity may be further increased with the liquid component where the oil and water are stable emulsions. Furthermore, the solid particles may be fine and/or low density, and may contribute to forming a "complex emulsion" of these solids, oil, and water. The use of traditional coagulants and flocculants may not work well in OBS compositions. Demulsifier chemicals ("demulsifiers") may be required to separate the oil and water components; however, demulsifiers may not work in all cases, particularly when the slurry is a homogenized highly stable emulsion. For OBS compositions that are "loosely" emulsified, a combination of surfactants, coagulants and flocculants along with centrifugal forces may result in a good recovery of oil and volume reduction, however a waste sludge or cake with relatively high amount of solids is generated which requires further disposal or processing. Disposal options may be limited, as many landfills will not accept oily sludges. Disposal in salt caverns or bioremediation technologies are possible, along with incineration, but no valuable recoverable product is recovered from the waste sludge in all four options. Some options may result in increased greenhouse gas emissions and other airborne pollutants.

Processing options of the waste sludge from OBS compositions may be most effective when the valuable components, typically oil, but in some cases oil and/or solids, can be recovered. This may accomplished using evaporative technologies referred to as thermal desorption followed by condensation. When the feed slurry or sludge contains fine solids that cannot be separated using mechanical forces or combined chemical and mechanical forces, the feed slurry or sludge sees no volume reduction. Disposal options, such as salt caverns and incineration may be utilized but suffer similar drawbacks as previously mentioned. Although OBS compositions may be processed using known thermal desorption technology, in known methods the composition must be fed directly to the equipment. In this case, significant oil and water remain in the feed OBS composition, and the removal of the oil and water through evaporation requires significant amounts of energy in addition to the careful management of hydrocarbon vapors at elevated temperatures.

Recovery of hydrocarbons from non-inert and inert solids has been proposed in several patent documents for application in the plastics art, oil refining art, shale retorting art, and the like, however, they are typically selected from filtration, drying, extraction, centrifugation, calcining and other separation methods, and therefore either do not work well and/or require inordinate amounts of energy for the amount of oil or solids obtained.

At least for these reasons, it would be an advance in the art of recovery of hydrocarbons and/or valuable solids (such as catalyst fines or metals) from waste streams if the hydrocarbons and water could be removed or separated from hydrocarbon/water/inert solids mixtures efficiently to recover substantially all of the hydrocarbons, as well as produce a solids composition more suitable for reuse, recycling, or land filling.

SUMMARY

In accordance with the present disclosure, systems and methods are described which overcome one or more of the above-mentioned problems.

A first aspect of the disclosure is a method comprising:

feeding a feed composition comprising inert solids, liquid hydrocarbons and liquid water to a thermal extraction unit comprising an external casing defining an internal thermal extraction chamber in which first and second intermeshing screws rotate at the same speed, the screws each comprising a shaft and a plurality of screw elements, the screw elements on the first screw configured to be in close tolerance to adjacent screw elements on the second screw, and all screw elements in close tolerance with inside surfaces of the casing, and wherein portions of the casing, shafts and screw elements define a tortuous flow path in which the feed composition and a substantially vaporous composition evolved therefrom flow, the substantially vaporous composition comprising co-mingled hydrocarbon vapors, water vapor, and fine particles of the inert solids; and reducing pressure while increasing temperature in the thermal extraction chamber as the plurality of intermeshing screw elements push the feed composition toward a discharge end of the thermal extraction chamber at a first velocity, while rotating the screws at a speed sufficient, in combination with geometry of the screws and casing, to create turbulent vacuum thermal conditions in the thermal extraction chamber sufficient to physically transform some or all of the feed composition into the substantially vaporous composition, and optionally forming a heated, substantially dry, depleted feed composition comprising non-fine particles of the inert solids, the substantially vaporous composition traversing the tortuous flow path with a second velocity at least 1.5 times the first velocity.

The feed composition can sometimes further comprise dissolved solids, in which case, the substantially vaporous composition can sometimes further comprise dehydrated dissolved solids.

Exemplary methods of this disclosure are carried out continuously, that is, the feed composition is continuously fed to the thermal extraction unit and travels through the thermal extraction chamber in continuous flow, with both screws rotating at the same speed ranging from about 20 to about 200 rpm. In certain other methods of this disclosure the composition travels through the thermal extraction chamber continuously in plug flow, with the thermal extraction unit configured to separate solids having maximum diameter of 10 micrometers, and the substantially vaporous composition traversing the tortuous path at a second velocity that is at least 3 times the first velocity in the thermal extraction chamber. In certain embodiments the second velocity may be one or more orders of magnitude greater than the first velocity.

A second aspect of the disclosure is a system comprising:

a thermal extraction unit comprising an external casing defining an internal thermal extraction chamber having a length, a width, and a height;

the casing having one or more feed ports, one or more outlet ports, an internal surface and an external surface, at least portions of the external surface configured to accept heat therethrough to the inside surface and indirectly heat in the thermal extraction chamber a composition comprising inert solids, liquid hydrocarbons and liquid water;

the casing configured to contain first and second rotatable intermeshing screws positioned in the thermal extraction chamber, the screws each comprising a shaft and a plurality of screw elements, the screw elements on the first screw configured to be in close tolerance to adjacent screw elements on the second screw, and substantially all screw elements in close tolerance with the internal surface of the casing, wherein portions of the internal surface of the casing, shafts and screw elements define a tortuous flow path in which the feed composition and a substantially vaporous composition evolved therefrom flow at a first velocity, the substantially vaporous composition comprising co-mingled hydrocarbon vapors, water vapor, and fine particles of the inert solids (and sometimes dehydrated solids when dissolved solids are present in the feed composition); and wherein the casing, shafts, and screw elements comprise one or more materials suitable for processing the composition via heat, reduced pressure, and turbulence to form the substantially vaporous composition and optionally a heated, substantially dry, depleted feed composition comprising non-fine particles of the inert solids (and sometimes dehydrated solids when dissolved solids are present in the feed composition), the substantially vaporous composition traversing the tortuous flow path with a second velocity at least 1.5 times the first velocity.

Certain systems of this disclosure, or components thereof, may be truck-mounted, rig-mounted, or skid-mounted. Certain systems may be modular, in that certain sub-systems may be available on separate vehicles.

Systems and methods of this disclosure will become more apparent upon review of the brief description of the drawings, the description of the best modes for carrying out the invention, and the claims that follow.

BRIEF DESCRIPTION OF DRAWINGS

The manner in which the objectives of the disclosure and other desirable characteristics may be obtained is explained in the following description and attached drawings in which.

Figure 1:
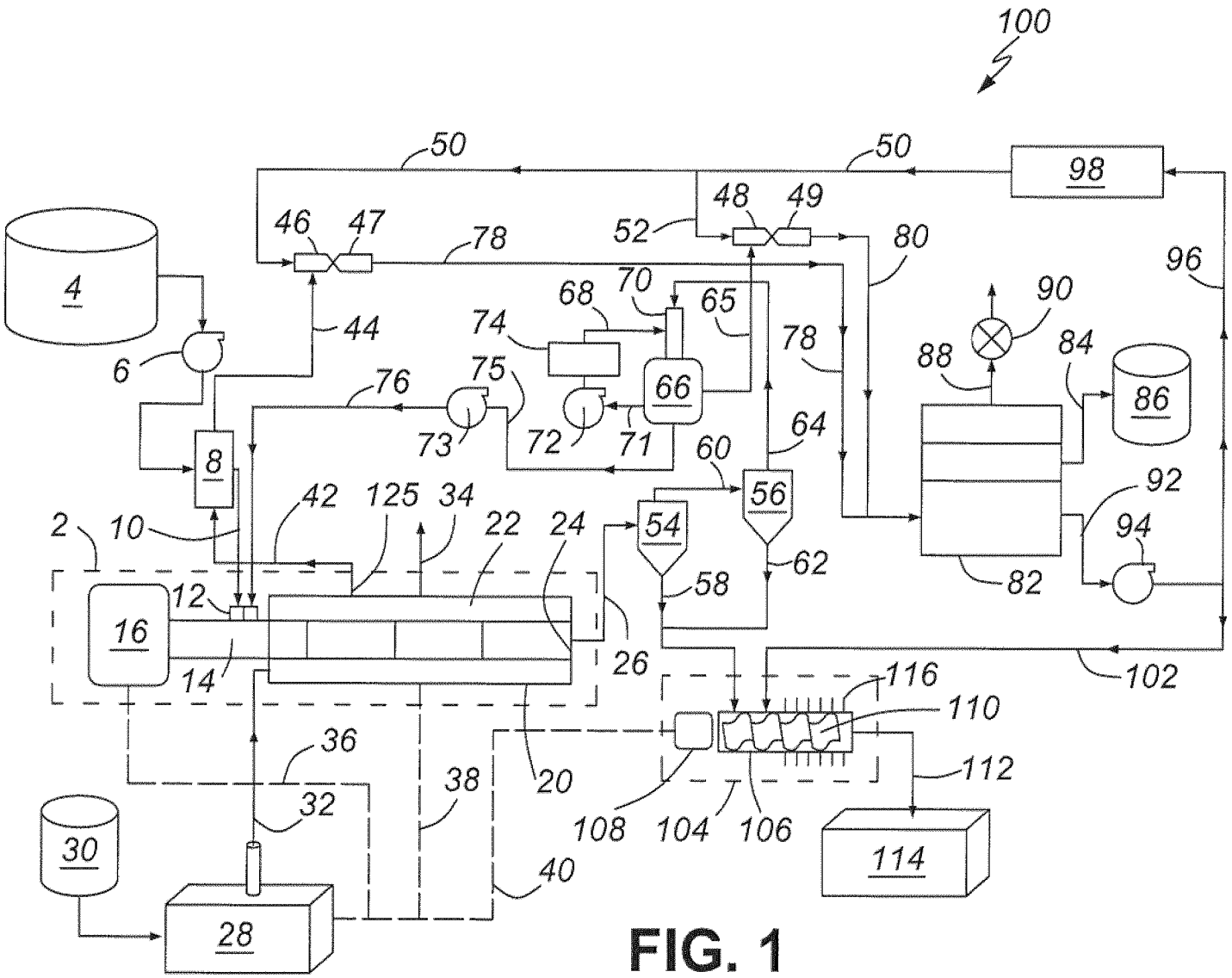
FIG. 1 is a schematic process flow diagram, partially in cross-section, of one non-limiting system embodiment in accordance with the present disclosure.

It is to be noted, however, that the appended drawings of FIGS. 1-20 and 23 may not be to scale and illustrate only typical embodiments of this disclosure, and are therefore not to be considered limiting of its scope, for the disclosure may admit to other equally effective embodiments.

DETAILED DESCRIPTION OF EMBODIMENTS OF THE INVENTION

In the following description, numerous details are set forth to provide an understanding of the disclosed systems and methods. However, it will be understood by those skilled in the art that the systems and methods covered by the claims may be practiced without these details and that numerous variations or modifications from the specifically described embodiments may be possible and are deemed within the claims. All U.S. published patent applications and U.S. patents referenced herein are hereby explicitly incorporated herein by reference. In the event definitions of terms in the referenced patents and applications conflict with how those terms are defined in the present application, the definitions for those terms that are provided in the present application shall be deemed controlling.

It has been discovered that the use of a specially designed thermal extraction unit, in certain embodiments in combination with one or more other unit operations, may fully accomplish separating fine solids from other components of a feed composition such as an oil-based slurries in a simple, effective way. The methods and systems of the present disclosure may be employed to separate and recover hydrocarbons, water, and solids for recycling or reuse from oil-based slurries containing fine solids and emulsified oils. The methods and systems of the present disclosure utilize thermal energy in a turbulent thin film flow regime while under reduced pressure (sometimes referred to here as "vacuum") conditions to desorb and condense hydrocarbons for recovery and recycling. While the methods may be performed in semi-continuous or even batch mode, continuous operation is believed to be particularly advantageous; it is believed no such technology exists today. Methods and systems of the present disclosure take advantage of high vacuum (low or reduced pressure) conditions to lower the effective boiling point of hydrocarbons resulting in lower operating temperatures than previous employed systems and methods, thereby recovering hydrocarbons with little or no degradation of the input hydrocarbons.

The methods and systems of the present disclosure may be employed to thermally desorb water and hydrocarbons from solids contained in all types of slurries. The thermal extraction unit increases the temperature of the feed slurry sufficiently to increase the vapor pressure of the liquids resulting in a phase change of the liquids to vapor while not chemically affecting the inert solids. The separated hydrocarbon and water vapors are evacuated and recovered for recycling or reuse. In certain embodiments, prior to being recovered the vapors may be condensed.

The following is a non-limiting summary of some of the slurries that may be treated using systems and methods of the present disclosure. While all feed compositions will be treated by a thermal extraction unit as described herein, and reasonably foreseeable functional and structural variations thereof that will be apparent to those of skill in this art, not all feed compositions will require all the features of methods and systems embodiments described herein.

Waste oils, slop oil from refineries, oil sludge from lagoons and used emulsions are posing disposal problems for the industry. They come from drainages, residues and cleaning processes, especially cleaning oil tank bottoms. Most of these wastes contain high quantities of recoverable oil ranging from 10-90 percent with the remaining water and solids. When the solids are dense and large in diameter (typically greater than 1 micrometer, or greater than 10 micrometer in largest dimension), treatment using centrifugal technology may be economical, however the treatment produces a solids stream containing oil and water. This solids stream is a sludge that must be further processed to recover the remaining valuable oil and water. When the solids are less dense and small in diameter or largest dimension (typically less than 10 micrometers, or less than 1 micrometer), treatment using centrifugal technology is not possible even when chemicals such as demulsifiers, coagulants and flocculants are used, particularly in the case where oil content in the feed is high. Residual oil in the solids/sludge may be recovered by systems and method of the present disclosure.

Washing liquids are used in the metal-processing industry. Certain surface treatment processes in the metal-processing industry require thorough cleaning with washing liquids beforehand. To maintain the optimum cleaning effect and ensure continuity of production, entrained particles and tramp oils can be separated out early using centrifugal methods subject to particle size, density and quantity limitations; residual oil in the sludge may also be recoverable. The life of the cleaning liquid can be extended, wear to the machine tools reduced, and the quality of the machined work pieces enhanced if the solids can be separated. Residual oil and metals in the solids/sludge may be recovered by a system and method of the present disclosure.

Lubricating and hydraulic oils must be continuously rid of water and dirt particles less than 10 micrometers in maximum diameter, in some cases less than 1 micrometer, since the entrained foreign matter may lead to corrosion, blockage and malfunctions in systems in which they are used. In the steel industry, for example, lube oils are used to lubricate roller bearings. During the rolling process, water may seep into the oil through the open bearings. Residual oil in the solids/sludge may be recovered by a system and method of the present disclosure. The clean oil ensures permanent smooth operation. The industry benefits from longer bearing life, higher machine availability and lower purchasing and disposal costs for the oil.

Operating fluids such as coolant emulsions or coolant oils must be regularly rid of solid impurities and water. Early and efficient action reliably avoids machine downtime and unhygienic production conditions. In metal-processing, so-called coolant emulsions are used to reduce the frictional and forming energy, to dissipate heat, and to flush away metal shavings formed during machining and forming operations. To be able to fulfill these diverse duties as an "anti-metal corrosive agent", the emulsions may be composed of different components, such as emulsifiers, stabilizers, corrosion protection additives, high-pressure additives and mineral oil components—complex mixtures that may experience bacterial contamination and decay. Entrained impurities such as metal shavings and tramp fluids may enhance the aging process. Where applicable and subject to particle size, density and quantity limitations, operating fluids may be treated by a separation unit to separate and recover coolant oils, and residual oil and solids in the solids/sludge may be recovered by a system and method of the present disclosure, optionally directly integrated into production, to ensure smooth processing by means of early partial stream purification. The result is an increase in the life of the coolants along with lower disposal costs.

"FPSO" is an acronym for "Floating Production Storage Offloading"—vessels similar to tankers that are moored at underwater wells for the temporary storage and treatment of crude oil. They are not generally driven, but do have diesel engines or turbines for generating electricity that employ fuel oil and lube oils. Centrifugal separators may remove fine solids from the fuel oil and lube oil for these units but generate a sludge. This sludge must be stored, transported to shore and disposed. This can disrupt operations under adverse weather conditions. The separators are often installed on deck on the FPSO. Residual oil and solids in the solids/sludge may be recovered by a system and method of the present disclosure, optionally directly integrated into production.

Contaminated oil drilling fluids and drill cuttings may be a considerable potential hazard to sensitive marine ecosystems. Drilling fluids are viscous emulsions that are circulated through the drilling pipe during drilling for crude oil or gas in order to pump the drill cuttings to the surface for processing. These emulsions may rapidly become contaminated with mud, salt water and oil residues. This means that the drilling fluids may have to be continuously cleaned to ensure a smooth drilling process. Typically, drilling fluids containing drill cuttings are treated by systematically segregating and removing large to fine solid particles from the fluid sufficiently so that the majority of the fluid can be circulated to the drill bit. The appropriate fines solids content is maintained using a combination of vibrating screens, hydrocyclones and centrifuges. However, towards the end of the drilling process several waste streams are generated, including a spent drilling fluid stream, oil-contaminated drill cuttings, and contaminated water from tank clean up operations.

Spent drilling fluids are an oil based slurry that typically contain clay and barite fine particles less than 10 micrometers in largest dimension, and ranging from about 5 to about 60 percent solids (wt. percent) with the remaining oil and brine in viscous emulsion. These compositions may be outside the range of centrifuges to effectively separate the valuable oil. Contaminated drill cuttings form a sludge/semi-solid that typically contains from about 5 to about 60 percent (wt. percent) oil and brine emulsion with the remaining solid drill cuttings generated from the well bore. These compositions are generally not a suitable feedstock for a centrifuge. Both spent drilling fluids and contaminated drill cuttings are challenging wastes to manage due to limited technologies available to separate the valuable oil from the solids fraction. Only a thermal desorption based technology is capable of processing these waste streams. Residual oil and solids in the solids/sludge may be recovered by a system and method of the present disclosure, optionally truck-, rig-, or skid-mounted.

During crude oil pumping or drilling, so-called "drain water" or "slop water" may accumulate. This water may be polluted to a greater or lesser extent with oil and fine solids and may not be discharged into the sea from offshore production platforms, drilling platforms, FPSOs, or FSOs (floating storage and off-loading vessels) until it has undergone an appropriate deoiling process. This drain or slop water is deoiled typically using a centrifuge to the legally specified extent to guarantee that the marine ecosystem is protected. The deoiling centrifuge generates a sludge consisting of the fines in the drain/slop water and residual oil and water. This sludge waste stream must be handled, stored and disposed at great expense. Residual oil and solids in the sludge may be recovered by a system and method of the present disclosure, optionally rig- or skid-mounted.

In order to make petrol (gasoline) or other fuels from heavy fractions of crude oil, refineries may employ a catalytic cracking ("cat cracking") process that employs a catalyst. "Cat fines" may comprise silicon and aluminum compounds that are required as catalysts in cat cracking processes. As cat fines may be extremely damaging to engines, these substances must be reliably removed from the produced fuels making it possible to feed certain cat fines straight back into the catalyzing process. Cat cracking takes place in special cracking towers at a temperature of around 500° C. After the conversion, there is then a large quantity of cat fines in both the residues of the cracking towers and the distilled fuel products. For those catalyst particles that are of large size and density, typically a settling clarifier and centrifuge may be used, however a waste sludge/solids stream may be generated which contains significant amount of valuable hydrocarbons. For those catalysts that are too fine for a centrifuge, another separation process is required.

Also, catalysts become spent over time due to fouling from carbonization that blocks the catalytic reaction from occurring on the catalyst surface. Systems and methods of the present disclosure may be used to recover valuable hydrocarbons while recycling the catalyst.

Varied businesses may produce many different types of paint and ink waste in their manufacturing processes or as a result of the services they provide. Some may contain toxic metals at or above legal limits. Examples of paint and ink wastes that may be hazardous include unusable liquid paints, stains, or inks; paint-thinner wastes of all types; paint spray-booth filters and arrestors; scrapings from paint booth walls and floors; paint-stripping waste; rags containing paint, ink, and/or solvent; sludge from distilling paint-thinner waste; and blanket and fountain washes and other cleanup materials. Most paint and ink wastes contain little water and comprise low and high boiling point hydrocarbons and relatively low amount of solids (less than 50 wt. percent). Solvents generally used during cleanup may be hazardous wastes as well as air pollutants. Wastes improperly managed may harm human health and/or the environment in addition to the expense of disposal of the paint and ink slurries and sludges. Solvents and residual solids in paint and ink wastes may be recovered by systems and methods of the present disclosure, optionally truck- or skid mounted.

Various terms and phrases are used throughout this disclosure. The term "OBS" means "oil-based slurry", a composition comprising oil, water and solids, and may be used as a shorthand notation in some instances for the phrase "feed composition", and they are used interchangeably herein, although not all feed compositions may appear to be, or have the characteristics of a "slurry" per se. "Close tolerance" as used herein means that the components in question are so close as to generate frictional heat when the feed composition, or vapors, liquids or solids separated therefrom, pass between those components.

"Reducing pressure" as used herein means inducing a pressure on the composition that is less than the pressure being exerted on the OBS just before being introduced into the thermal extraction chamber. The pressure may be reduced 10 percent, or 20, or 30 or 50, or 70 or 90 percent of the pressure exerted on the OBS just prior to its introduction into the thermal extraction chamber. "Increasing temperature" means the temperature of the OBS is increased more than an insignificant amount, either 1) indirectly, for example using electrical Joule heating, combustion, or otherwise, or 2) directly through close tolerance frictional heating, or 3) both direct and indirect heating. "Turbulent" as used herein means generally having Reynolds number of 2000 or above, or 2500 or above, or 3000 or above, or 4000 or above. It is not critical that every portion of the thermal extraction chamber experience turbulence or turbulent flow conditions at every instant of continuous operation, however, if a majority or more portions of the chamber are experiencing turbulent conditions, in general the better mass and heat transfer will be in or to the chamber.

The term "solids" includes solid particulate objects of all shapes, composition (as long as inert under the pressure, thermal and turbulent conditions described herein), and morphology. Shapes may include, but are not limited to, spherical, hemispherical, quarterspherical, conical, square, polyhedral, ovoid, saddle-shaped, irregular, random, non-random shapes, featured or featureless shapes, contoured or non-contoured shapes, and the like. Morphologies may include single particles and agglomerates of two or more particles, crystals and non-crystalline solids, amorphous and partially crystalline and partially amorphous solids, nano-particles, nano-spheres, nanotubes, micro-particles, coated particles having one or more full or partial coatings, porous and non-porous solids, and the like. The term "solids", when used in the context of an OBS, includes hydrated chemicals, although the water of hydration will most likely be removed (volatilized) with any hydrocarbons and other water in the feed composition. The term "solids" also includes shaped particles that may be filled or infused with another compound or chemical, such as ceramic spheres filled with another substance. As used herein the term "hydrocarbon" includes compositions comprising molecules of only carbon and hydrogen, as well as compositions comprising molecules of carbon, hydrogen, and other elements, such as halogens, and non-halogens (oxygen, sulfur, nitrogen, and the like), and mixtures and combinations of these. Hydrocarbons may be derived from petroleum, coal tar, oil sands, shales, and plant and other biological sources. Hydrocarbons may be comprised of aliphatic (straight or branched chain paraffinic and/or olefinic) and or cyclic, such as benzene, chlorobenzene, toluene, xylene, and the like. The term "emulsion" includes oil-in-water emulsions, water-in-oil emulsions, and complex emulsions, the latter being where the solids are so fine and charged that the solids become a part of the emulsion.

The term "dissolved solids" means solids that are dissolved in a solvent. Certain feed compositions can contain dissolved solids, such as oil product recovered from oil sands using steam assisted gravity drainage (SAGD). The blowdown from evaporators that treat produced water from the SAGD process can have an elevated level of dissolved solids and has been difficult to dispose of. The dissolved solids may be removed by a system and method of the present disclosure. The essentially distilled water can then be re-introduced into the steam generating system.

The term "dehydrated dissolved solids" means solids that contain 1% or less of the original solvent.

The term "intermeshing" means screw elements of one screw (screw elements are sometimes referred to herein as "flights") extend generally toward the shaft of the other screw and that at least a portion of each element moves between two neighboring screw flights on the other shaft as the shafts rotate. The screws may rotate the same direction, or counter-rotate (rotate in opposite direction).

The term "tortuous" when used in the phrase "tortuous flow path" means a generally non-linear route through the chamber, by virtue of the close tolerance of the screw elements to the inside surface of the casing. It does not rule out, however, the possibility that some of the flow path may include linear portions. The phrase "flow path" includes singular and plural flow paths.

The phrase "substantially vaporous composition" means compositions comprising about 1 percent or less by weight of fine particles of the inert solids, in certain embodiments about 0.5 percent or less, in certain embodiments about 0.1 percent or less by weight fine particles of the inert solids, and in yet other embodiments a trace or less of inert solids. The substantially vaporous composition may comprise dehydrated dissolved solids if dissolved solids are present in the feed composition. The vapors and some or all of the fine particle inert solids (having diameter less than about 10 micrometers, or less than about 1 micrometer) may leave the thermal extraction chamber as separate but comingled physical phases. The phrase "turbulent vacuum thermal conditions in the thermal extraction chamber sufficient to physically transform some or all of the feed composition into the substantially vaporous composition" means that the thermal extraction chamber is at pressure, temperature and turbulence conditions sufficient to volatilize all but the most stubbornly adherent hydrocarbons and water from the solids. Although the amount of hydrocarbons and water volatilized (separated) from feed compositions may vary from system to system, certain systems and methods in accordance with the present disclosure may volatilize about 95 percent or more by weight of the hydrocarbons and water from the feed composition, or about 99 percent or more of the hydrocarbons and water, or about 99.9 percent or more. As used herein the phase "heated, substantially dry, depleted feed composition" means the solids exiting the thermal extraction chamber, and have about 90 weight percent or more of water and hydrocarbons removed from the feed composition, in certain embodiments about 95 percent or more, and in certain exemplary embodiments about 99.9 weight percent or more removed. The phrase "inert solids" means that the solids (excluding dissolved solids) are essentially non-chemically reactive toward other constituents in the feed composition and toward each other, although there may be some small percentage of the solids that chemically react by desorbing water of hydration, or evolved gases that react (for example carbon monoxide reacting with oxygen present to produce carbon dioxide). These latter reactions are considered largely irrelevant to the systems and methods of the present disclosure, although for completeness they should be mentioned, as they may contribute some small heating effect.

It should be readily understood by reading this disclosure that increasing temperature occurs through both indirect and direct heating. By "direct heating" is meant heat generated by friction caused by the high shearing from the close tolerances. In certain embodiments temperature in the thermal extraction chamber may be increased to the boiling point of the target hydrocarbon(s) adjusted for the reduced pressure in the chamber. It should also be understood that the velocity of the substantially vaporous composition may be orders of magnitude higher than the velocity of the OBS or solids being pushed by the screws. In certain embodiments, in order to maintain reduced pressure conditions in the chamber, the feed may be pumped using a positive displacement pump capable of holding a seal—such as a peristaltic pump, a rotor/stator pump, a gear pump, or a piston pump. Also, in certain embodiments the screw shafts may be sealed using a rotary seal between the chamber and atmosphere.

Certain methods and systems within this disclosure could be performed by one rotating screw intermeshing with an internal, "shaped" wall of the casing, but the amount of turbulence/shear mixing will be low, and may thus require a very long extraction chamber resulting in large shaft to overcome the torque, and therefore those processes and systems may not be as effective. In certain embodiments, the heated, substantially dry depleted feed composition comprises primarily inert solids, and this composition may be rehydrated by combining the heated composition with water cooled to form a rehydrated inert solids composition, and then the rehydrated composition may be cooled, for example by traversing a cooling section having a plurality of external cooling fins. In certain embodiments, water jacket cooling may be employed, with or without cooling fins. For example, in certain embodiments cooling water may be a slip stream or portion of re-circulated water separated from the OBS, the slip stream returned to the Oil/Water Separator after transferring heat indirectly from the heated solids to the slip stream. In certain embodiments, the cooling and rehydrating may be reversed. In certain embodiments the rehydrating and cooling may be performed in a unit attached directly to the thermal extraction unit through a seal section to prevent vacuum in the rehydration zone and communication of the solids back to the extraction zone. In this context, it should be pointed out that certain systems may be characterized as comprising certain "zones": the thermal extraction unit may comprise a feed zone, an extraction zone fluidly connected with and generally downstream of the feed zone, and a vent zone fluidly connected with the extraction zone, with a rewetting or rehydration zone fluidly connected with and downstream of the vent zone or extraction zone. In certain embodiments the venting zone may comprise more than one vent, and the venting zone may overlap with the extraction zone. In certain "in-line" system and method configurations, the rewetting zone may be isolated from the other zones by seals, for example using a change in pitch of screw elements so no material can advance into the rewetting zone. Labyrinth type seal elements may be used between the venting zone or extraction zone and the rewetting zone. In yet other embodiments, the rehydrating and cooling of the inert solids are performed in a unit physically separate from the thermal extraction unit. The heated, substantially dry depleted inert solids are first rehydrated in these embodiments to form a rehydrated inert solids composition, and then this composition cooled using a finned cooling section or other cooling means.

It should further be understood that certain methods and systems of this disclosure may process solids greater than 10 micrometers in largest dimension very easily, but there are other technologies, such as centrifuges, that may remove particles having largest dimension greater than 10 micrometers more cost effectively. There is no technical limit to processing as large as solids as possible as the screws will crush and pulverize the solids so that the solids can pass through the gaps between the screw shafts, screw elements, and internal surface of the casing. Proper precautions would be taken of course to control frictional heating, as such crushing and pulverizing will generate frictional heating. Certain methods and systems of this disclosure may therefore comprise a centrifuge or other large particle separation device and method upstream of the thermal extraction unit, should this be more cost effective for certain separation problems.

As used herein the terms "combustion gases" and "combustion products" mean substantially gaseous mixtures of combusted fuel, any excess oxidant, and such compounds as oxides of carbon (such as carbon monoxide, carbon dioxide), oxides of nitrogen, oxides of sulfur, and water. Combustion products may include liquids and solids, for example soot and unburned or non-combusted fuels. "Oxidant" as used herein includes air and gases having the same molar concentrations of oxygen and nitrogen as air (synthetic air), oxygen-enriched air (air having oxygen concentration greater than 21 mole percent), and "pure" oxygen, such as industrial grade oxygen, food grade oxygen, and cryogenic oxygen. Oxygen-enriched air may have 50 mole percent or more oxygen, and in certain embodiments may be 90 mole percent or more oxygen. The term "fuel", according to this disclosure, means a combustible composition comprising a major portion of, for example, methane, natural gas, liquefied natural gas, propane, hydrogen, steam-reformed natural gas, atomized hydrocarbon oil, combustible powders and other flowable solids (for example coal powders, carbon black, soot, and the like), and the like. Fuels useful in the disclosure may comprise minor amounts of non-fuels therein, including oxidants, for purposes such as premixing the fuel with the oxidant, or atomizing liquid or particulate fuels. As used herein the term "fuel" includes gaseous fuels, liquid fuels, flowable solids, such as powdered carbon or particulate material, waste materials, slurries, and mixtures or other combinations thereof. The sources of oxidant and fuel may be one or more conduits, pipelines, storage facility, cylinders, or, in embodiments where the oxidant is air, ambient air. Oxygen-enriched oxidants may be supplied from a pipeline, cylinder, storage facility, cryogenic air thermal extraction unit, membrane permeation separator, or adsorption unit such as a vacuum swing adsorption unit.

The term "chamber" means a channel or conduit defined at least by the internal surface of the casing. In certain embodiments the thermal extraction chamber may include a floor, a roof and a wall structure connecting the floor and roof. The chamber may have any operable cross-sectional shape (for example, but not limited to, rectangular, oval, circular, trapezoidal, hexagonal, and the like) and any flow path shape (for example, but not limited to, straight, zigzag, curved, and combinations thereof). The diameter, radius, height, width and length dimensions may be constant or changing from inlet to outlet of the chamber; generally, the dimensions are such that reduced pressure, increased temperature, and turbulent conditions exist in the chamber. The length may also depend on the Reynolds number of the substantially vaporous composition exiting the thermal extraction unit. Higher Reynolds numbers may require longer chambers to achieve the desired temperature homogenization.

Casings, screw shafts, and screw elements and associated structures, as well as conduits used in transferring materials between different operational units useful in systems and methods of the present disclosure may be comprised of metal, ceramic, ceramic-lined metal, or combination thereof. Suitable metals include carbon steels, stainless steels, for example, but not limited to, 306 and 316 steel, as well as titanium alloys, aluminum alloys, and the like. Suitable materials and thickness for the casing and screws are discussed herein below. In any particular system and method of this disclosure, the type of feed composition being processed may influence the chamber geometry, thermal extraction unit configuration, and associated structural features.

Specific non-limiting system and method embodiments in accordance with the present disclosure will now be presented in conjunction with the attached drawing figures. The same numerals are used for the same or similar features in the various figures, except where clarity is better served using another numeral. In the views illustrated in the drawing figures, it will be understood that in the case of FIGS. 1-20 and 23 that the figures are schematic in nature, and certain conventional features may not be illustrated in all embodiments in order to illustrate more clearly the key features of each embodiment. The geometry of the thermal extraction chamber is illustrated generally the same in the various embodiments, but that of course is not necessary.

FIG. 1 is a schematic process flow diagram, partially in cross-section, of one non-limiting system embodiment 100 in accordance with the present disclosure. Embodiment 100 illustrates how certain methods and systems of the present disclosure, sometimes referred to herein as the "TVT technology" or the "TVT process", extract hydrocarbons by creating a highly turbulent flow regime using a set of close tolerance intermeshing screws placed in a "casing", sometimes referred to herein as a Thermal Extraction Barrel ("TEB"). Embodiment 100 includes a thermal extraction unit 2, feed tank 4 (which may be open or sealed), a peristaltic (or other positive displacement) slurry feed pump 6, an optional feed preheater 8, and feed conduit 10 directing a feed composition in the form of slurry or OBS to a feed inlet 12 on TEB 14. TEB 14 includes a motor/drive unit 16, including a gear box that powers rotating screws 18A and 18B (not illustrated in FIG. 1, but fully described in reference to FIGS. 2 and 3, and other figures herein). Screws 18A, 18B also provide a method of conveying the slurry and solids fraction through TEB 14. In exemplary embodiments, feed slurry is fed into TEB 14 under flooded conditions.

In embodiment 100, thermal extraction unit 2 includes a shroud 20 that creates an annulus 22 between shroud 20 and TEB 14, and allows TEB 14 to be externally heated via a heat transfer fluid, such as hot oil or hot combustion gases flowing through annulus 22. Shroud 20 may not be present or required in all embodiments. Electrical resistance heating and/or induction heating (further discussed herein) may also be employed, alone or in combination with a hot heat transfer fluid, all which serve to heat TEB 14 and achieve increased temperature inside a thermal extraction chamber 15 (FIGS. 2 and 3) defined by inside surfaces of TEB 14, as will become more apparent herein. Embodiment 100 employs hot combustion exhaust gases supplied via an electrical generator 28 via one or more conduits 32 connecting annulus 22 with generator 28. A hydrocarbon fuel supplied via a tank or other source 30 may fuel generator 28. While embodiment 100 as illustrated schematically routes all of combustion exhaust gases from electric generator 28 to annulus 22, this of course may not be necessary in all embodiments. Cooled generator combustion exhaust gases emerge from annulus 22 through one or more conduits 34. Electric generator 28 may supply electrical power to motor/drive unit 16 and electric heaters for TEB 14 (not illustrated) via power cables 36 and 38, respectively.

TEB 14 may be designed such that it contains one or more vent sections or vent tubes 125 to continuously remove vapors generated in the volatilization of the liquid components of the feed slurry. Due to the highly turbulent environment in TEB 14, additional heat is generated through the conversion of mechanical energy provided from screw drive motor/drive unit 16 to thermal energy from the friction generated by screw—particle—TEB interaction. The indirect heating and the thin film created by the close tolerance intermeshing screws promote both nucleation boiling and film evaporation.

The TVT technology creates reduced pressure or vacuum in TEB 14 and vent zone(s) to lower the vapor pressure and boiling point of water and hydrocarbons. The reduced pressure or vacuum conditions are also used to convey the vapors out of TEB 14 as quickly as possible so as not to increase the risk of thermal cracking. In embodiment 100 illustrated schematically in FIG. 1, the reduced pressure or vacuum is created by a primary eductor 48, which may use water, oil, or combination thereof as its motive flow. Reduced pressure in chamber 15 of TEB 14 is induced through conduit 65, an Ultra Fines Scrubber ("UFS") 66, conduit 64, cyclone 56, conduit 60, cyclone 54, conduit 26, and TEB outlet 24. Embodiment 100 also includes a conduit 44, optional feed preheat heat exchanger 8, and conduit 42 connecting feed preheater 8 and one or more vent tubes 125 on TEB 14. In certain embodiments, primary eductor 48 may create up to 29 inches Hg vacuum thereby significantly reducing vapor pressure and boiling point of hydrocarbons in the feed which also may reduce thermal and catalytic cracking commonly exhibited in thermal desorption processes. Hydrocarbon cracking may generate undesirable odiferous compounds, which may often render the recovered oil useless, and therefore temperatures that would promote cracking are not desired, although some may be inevitable.

Referring again to FIG. 1, the feed slurry may be composed of fine solids typically less than 100 micrometers and particularly less than 10 micrometers in diameter or largest dimension that cannot be easily separated using mechanical separation. As a result, some or all of these fines may be entrained in the desorbed "substantially vaporous composition" stream and routed through one or more outlets 24 and conduits 26 of TEB 14 to one or more fines separation units. To reduce fines carryover into the recovered oil and water stream, one or more cyclone separators 54, 56 may be employed. In embodiment 100 of FIG. 1, primary cyclone 54 receives a feed of substantially vaporous composition through conduit 26, and separates this stream into a dry, heated solids stream flowing through a conduit 58, and a heated reduced solids vapor stream through another conduit 60, which routes this stream to secondary cyclone 56, where further reduction of solids occurs, producing a second heated solids stream through a conduit 62 and second heated reduced solids vapor stream through conduit 64. Temperature of primary cyclone 54 and secondary cyclone 56 may be maintained (using various heating mechanisms and/or insulation, not illustrated) at or close to the temperature of the substantially vaporous composition emanating from outlet 24 of TEB 14, to prevent or reduce premature condensation of water and hydrocarbons. This temperature may be 250° C. or greater in certain embodiments.

To further remove fines not separated by cyclones 54, 56, the vapors emanating from secondary cyclone 56 may be routed through a conduit 64 to a vessel 66, an upper portion 70 of which may contain one or more packed beds comprising one or more packed media. Vessel 66 and its upper packed bed portion 70 are referred to herein as an Ultra Fines Scrubber ("UFS"), and is essentially an oil scrubber where upper packed bed portion 70 is continuously flushed with an oil having a composition similar to that of oil in the feed slurry. One embodiment of a suitable UFS is illustrated schematically in FIG. 19, and described in more detail herein, but mention is made here that the oil is circulated through a conduit 71, oil circulation pump 72, a heat exchanger 74, and a return conduit 68, the heat exchanger used to maintain temperature of the circulating oil at temperatures ranging from about 100° C. to about 200° C. through the UFS to prevent build up of fines on the packed media. The packed media may comprise spherical shaped material having diameter ranging from about 10 to about 20 millimeters (mm) in diameter such as, but not limited to, glass and non-corroding metal. As viscosity of the circulating oil in the UFS builds up with fine solids, an optional slipstream may be directed through a conduit 75, sludge pump 73, and conduit 76 to TEB feed inlet 12.

Still referring to FIG. 1, embodiment 100 further includes a circulating water system, portions of the circulating water acting as motive fluid for primary eductor 48 (through conduit 52) and as motive fluid for a secondary eductor 46 (through a conduit 50) maintaining reduced pressure in vessel 66 and cyclones 54, 56. Circulating water also may be employed to condense any hydrocarbon vapors vented through conduit 44 from TEB 14 and conduit 65 routing a vapor substantially devoid of solids from UFS 66, 70 to primary eductor 48. Vent 125, if positioned ideally, will be primarily steam with some light end hydrocarbons. The circulating water condenses water vapor and hydrocarbon vapors very quickly in the eductor diffuser sections 47, 49 and downstream of eductors 46, 48. The motive flow water along with the condensed water and hydrocarbons enter an oil water separator 82 via conduits 78, 80 fluidly connecting eductors diffusers 47, 49, respectively to oil water separator 82, where the hydrocarbons are easily recovered and transferred though a conduit 84 to an oil storage tank 86 or other end use. The water separated in oil water separator 82 may be drawn off via a conduit 92 and pump 94, and a portion or all of the water re-circulated and pumped back into eductors 46, 48 as motive fluid though conduit 96. Prior to recirculation of the water, passing the water through a heat exchanger, such as fin-fan cooler 98, to remove excess energy, may control the temperature of the water. A slip stream of water substantially equal to the rate of water content in the feed slurry may be removed through another conduit 102 and transferred to a water storage tank (not illustrated). This water may be further treated using standard water treatment technology to filter trace hydrocarbons (using for example activated carbon) or with coagulants and flocculants to reduce suspended solids. Hydrocarbon vapors may be captured in the upper reaches of oil water separator 82 and vented through a conduit 88 and filter 90 before being routed for one or more end uses. Certain systems and process embodiments may operate effectively without eductor 46 or any vents 125.

Solids traversing through conduits 58 and 62 are cooled and re-hydrated in a separate solids rehydration and cooling unit 104, comprising its own casing 106 and screw or screws 110 driven by its own motor/drive unit 108. Cooling fins 116 attached to casing 106 may enhance cool-down of the solids passing through casing 106. Cooled and rehydrated solids may be discharged from separate rehydration and cooling unit 104 through a conduit 112 to a solids discharge container 114. Water from oil water separator 82, maintained at around 1 to 20° C. above ambient temperature through use of fin fan cooler 98, may be routed through conduit 102 for rehydrating the solids, and/or fresh water may be used.

In prior art technologies, cooling and rehydration of treated solids may be complex and inefficient, and may require air locks to separate the thermal processing from the jacketed cooling auger followed by rehydration in a pug mill, processes of rehydration that may be plagued with issues such as leaking air locks in an abrasive and high temperature environment. In addition, significant steam and fine particles may be emitted from a pug mill, species that are difficult to capture and contain. In contrast with these technologies, certain methods and systems of the present disclosure utilize processes where solids cooling and rehydration may take place within the same TEB 14 (as exemplified in the discussion of FIG. 3 herein).

In certain method and system embodiments of the present disclosure, it may be desirable to eliminate the use of one or more, or all cyclones, particularly where the substantially vaporous composition emanating from TEB 14 contains about 90% particulate sizes less than 2 micrometers. In these situations, certain systems and methods of the present disclosure may utilize the dual eductor loop system as previously described in a slightly different arrangement, bypassing cyclones 54, 56, or eliminating them entirely. In these embodiments, the first loop may utilize secondary eductor 46 and a hydrocarbon as the motive fluid, possibly of similar type as contained in the feed slurry. Secondary eductor 46 in these embodiments may be designed to condense only hydrocarbon vapors, and operate at the boiling point of water or higher, for example about 105° C. or higher temperature. The operating temperature of secondary eductor 46 may be set by the temperature of the motive flow fluid which may be controlled by removal of heat and circulating flow rate. Heat may also be removed through a simple heat exchanger and control logic. The purpose of vent 125 is to allow removal of steam and low end hydrocarbon vapors while leaving the rheological properties of OBS such that it is cohesive and will flow albeit potentially at higher viscosities containing only oil and solids. Vent 125 should not see any particulate. These embodiments may also comprise one or more surge vessels where the liquid hydrocarbons are collected. The surge vessel may be designed to operate at elevated temperatures while withstanding vacuum pressure conditions. A slip stream of oil may be removed from the surge vessel substantially equal to the rate of hydrocarbon content in the feed slurry and transferred to the recovered oil tank. During transfer, the oil may be cooled using standard heat exchangers to near ambient temperatures. The recovered oil may later be filtered to remove particulate captured in the primary loop using standard filtration technologies. A second loop utilizes primary eductor 48 where water is used as the motive fluid similar to the standard process as previously described but without the cyclones. The water vapor which is removed from the surge vessel just described and condensed using cooled water as the motive fluid in primary eductor 48 enters oil water separator 82 for separation of any low boiling point hydrocarbons. In these embodiments a portion of the water may be cooled and recirculated via pump 94 to primary eductor 48, as previously described.

Figure 3:
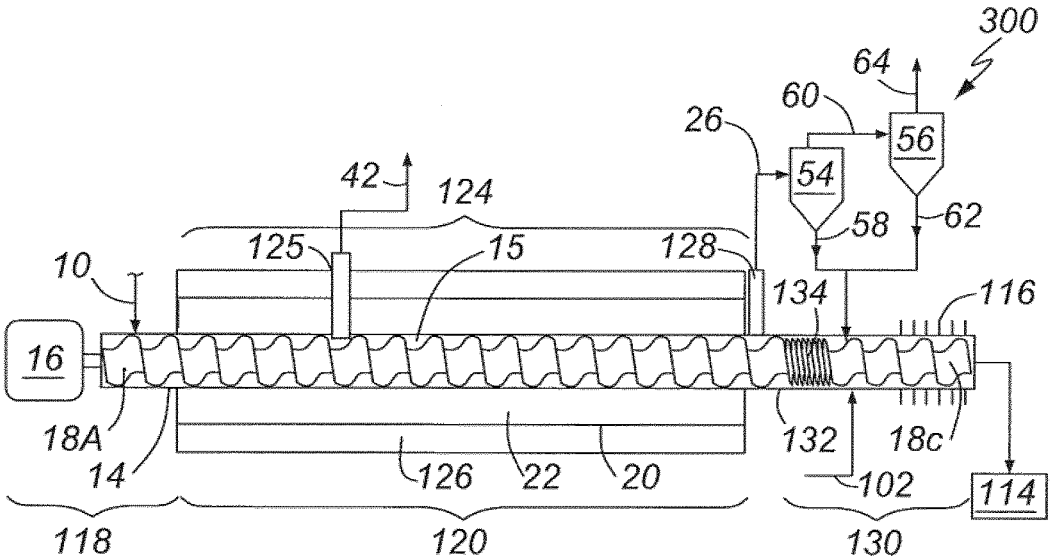

In certain method and system embodiments of the present disclosure, such as in embodiment 300 illustrated schematically in FIG. 3, thermal extraction unit 2 may utilize a "once through" process, where heated, substantially dry, depleted feed composition comprising non-fine particles of the inert solids traverse one or more flow paths "in line" with TEB 14, and which may then be safely disposed of simultaneously using the same continuous process where the substantially vaporous composition desorption takes place. The feed composition can also sometimes include dissolved solids. Embodiment 300 may be described as including a feed zone 118, a desorption and vapor evacuation zone 120, a vent zone or zones 124, and a rehydration and cooling zone 130. Portions or all of these zones may be insulated using insulation 126. A portion or portions of the vapors forming the substantially vaporous composition may be removed in vent zone 124 midstream of desorption and vapor evacuation zone 120, and/or combined with vapors and solid fines which are passed through one or more cyclones through a vent tube 128 near the distal end of TEB 14.

Still referring to FIG. 3, to prevent communication between desorption and vapor evacuation zone 120 and the solids discharge conduits 58, 62 of cyclones 54, 56 respectively, a series of labyrinth seals 134 may be used. Seals 134 may comprise one or more screws having screw elements (also referred to as "flights") attached to extensions of the shafts of screws 18A, 18B, and may contained in a casing extension 132 of casing (TEB) 14 and direct the flow of the desorbed vapors to cyclones 54, 56 through vent tube 128 and conduit 28, thus isolating the flow of the solids discharged from cyclones 54, 56. (FIG. 9 defines the various terms used herein to describe screws and their geometry used in TEB 14 and in casing extension 132.) Seals 134 should have minimal clearance between their flights and inside surfaces of casing extension 132, such as 0.5 micrometer or less. The seal flights should also have zero or near zero flight angle "α" and a flight width "W" ranging from about 0.1 to about 0.4 times, or from about 0.05 to about 0.2 times the screw diameter "D", resulting in a decreased flight pitch "P" with increased number of flight than compared to these dimensions of screws 18A, 18B in TEB 14. There may be from 0 to about 10 (or more) flight seal pitches. Casing extension 132 also contains screw sections 18C, 18D (the latter not illustrated in FIG. 1), which have screw geometry similar to the geometry of screws 18A, 18B, respectively.

Figure 2:
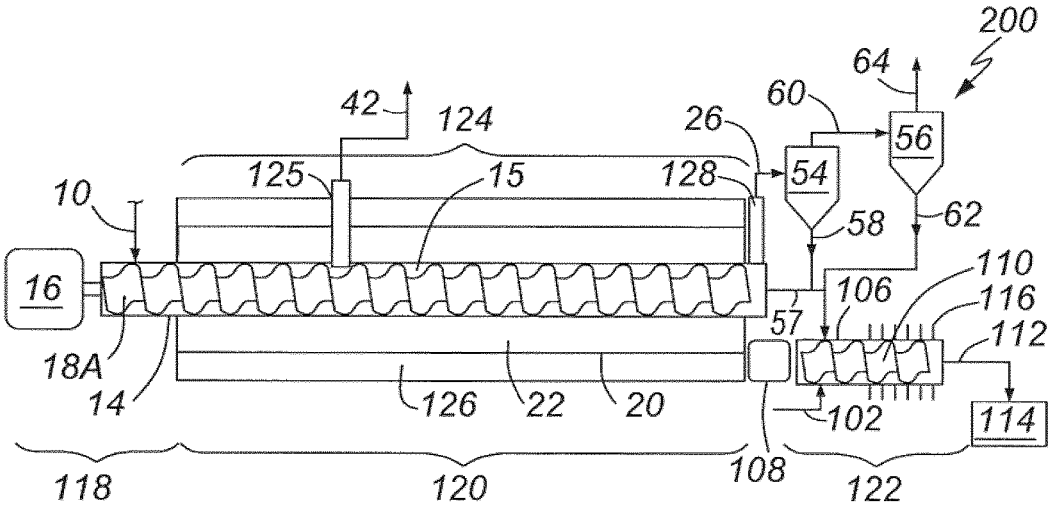
FIGS. 2 and 3 are schematic illustrations, partially in longitudinal cross-section, of two alternative embodiments of thermal extraction units in accordance with the present disclosure.

Another alternate configuration is illustrated schematically in FIG. 2. Embodiment 200 utilizes an external discharge section 122, similar to rehydration and cooling unit 104 of embodiment 100, where heated, substantially dry, depleted feed composition comprising non-fine particles of the inert solids (and dehydrated dissolved solids when dissolved solids are present in the feed composition) are cooled and re-hydrated in a separate cooling and rehydration chamber ("CRC"). The primary difference between embodiments 100 and 200 is that in addition to heated solids flowing from cyclones 54, 56 through conduits 58, 62 to rehydration and cooling unit 104, an additional discharge conduit 57 provided directly from TEB 14 to rehydration and cooling unit 104. The solids from TEB 14 and conduit 57 may be mixed with solids from cyclones 54, 56 prior to entering unit 104, or they may be routed separately to one or more different inlet locations in unit 104. The solids stream in conduit 57 may also be routed to a separate holding vessel before being directed to unit 104.

In most embodiments, once the hot solids are introduced into rehydration and cooling unit 104, the flight geometry will be similar to that in thermal extraction unit 2. Also, the water re-hydrates the hot solids so that the solids may be ejected through an orifice from casing 106 into conduit 112 to ensure a seal that will prevent any leakage air from entering TEB 14. As described, the CRC may comprise fins to aid in the removal of heat, and may comprise an air blower, a cooling jacket for circulating a heat transfer (cooling) fluid, or combination of these.

Figure 4:
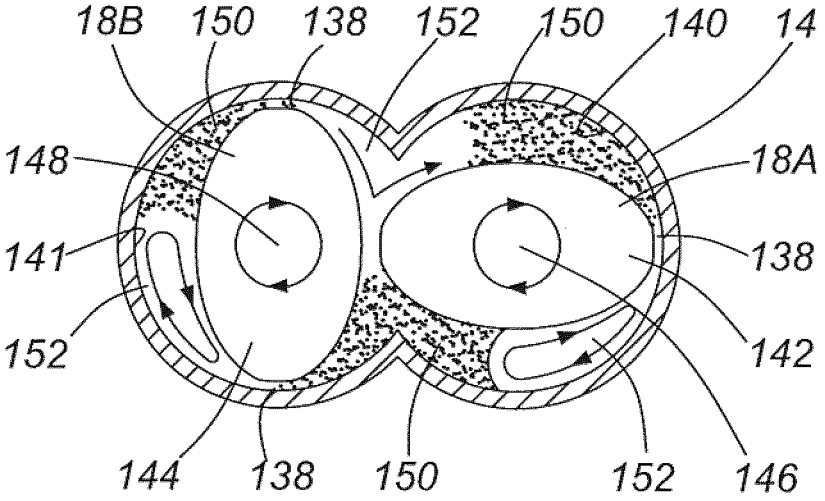
FIG. 4 is a schematic cross-section view of one embodiment of a casing and two intermeshing screws.
Figure 4A:
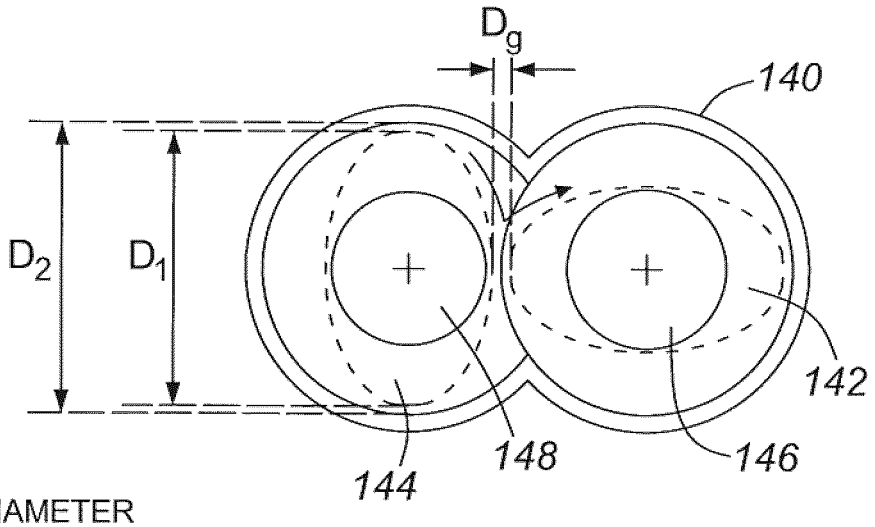
FIG. 4A illustrates schematically some of the dimensions of this embodiment.
Figure 5A:
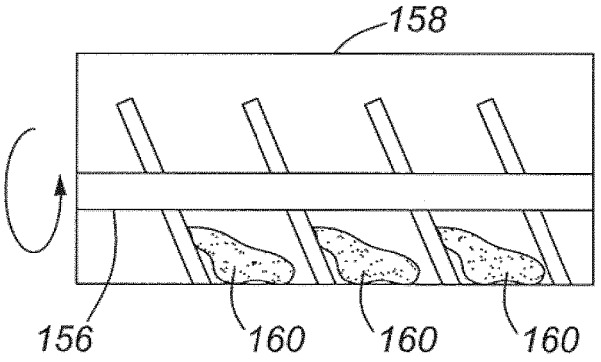
(PRIOR ART) FIG. 5A
FIG. 5A is a schematic longitudinal cross-section view, and FIG. 5B a schematic cross-sectional view of a prior art indirectly heated device, such as a screw and auger separator, or heated rotary kiln such as a calciner, with FIG. 6A schematically illustrating certain disadvantageous features of prior art indirectly heated device designs compared with methods and systems of the present disclosure, as illustrated schematically in FIG. 6B.
Figure 5B:
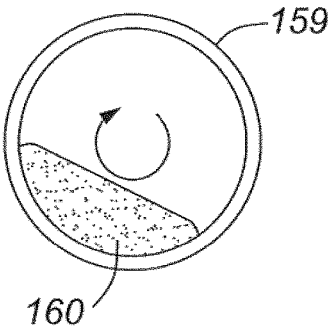
(PRIOR ART) FIG. 5B

Referring now to FIGS. 4 and 4A, and Table 1, efficient heat and mass transfer rely not only on a combination of turbulence, temperature, and time (residence), but also reduced pressure. It is well understood by the industry that turbulence, temperature and time primarily dictate heat and mass transfer. However, reduced pressure certainly aids in improved heat and mass transfer, but as previously discussed, no one has been able to practice a continuous system under high turbulence, high temperatures and controlled residence time while under significant vacuum. The TVT technology utilized in methods and systems of the present disclosure attempts to maximize the effects of all four in several novel ways. Turbulence is created by a unique combination of close gap intermeshing screws and narrow gap between the screws 18A and 18B and inside surface 140 of TEB 14. As illustrated schematically in the cross-sectional view of FIG. 4, screws 18A, 18B rotate in the same direction, although counter-rotation is also possible through suitable gearing. In the configuration illustrated, screw element 142 is attached to screw shaft 146, and screw element 144 is attached to screw shaft 148. Thin film areas 138 are formed between screw element 142 and inside surface 140 of casing 14, and between screw element 144 and inside surface 141 of casing 14. Regions where slurry and inert solids are experiencing turbulence, reduced pressure, and increased temperature are denoted at 150, and regions where desorbed vaporous composition with possible entrained fine solids accumulate are illustrated at 152, with arrows indicating schematically movement in various regions. While FIG. 4 indicates co-rotating screws, similar thin film flow patterns are generated with counter-rotating screws.

In reference to FIG. 4A the gap or "delta", defined as D2−D1, where D2=inside diameter of TEB 14, and D1=screw diameter, is in certain embodiments less than 1.0 mm, or less than 0.7 mm, or even less than 0.5 mm, depending upon diameter D1 of the screw. The ratio of screw diameter to gap, D1/(D2−D1), may range from about 360 and 9,000. As discussed herein, the slurry is not only conveyed down the length of TEB 14 but is believed to be sheared in the narrow gap "Dg" between the screws themselves (FIG. 4A), and between the screw flights 142 on shaft 146 and screw flights 144 on shaft 148 and inside wall 140 of TEB 14 while creating a thin film, or a number of thin film regions 138. The thin film(s) maximize mass transfer of the vapors 152 to the head space of chamber 15 for removal via vent zone(s) and increases heat flux. It is believed the vapors travel at high velocity through the narrow gap geometry (much higher than solids 150), which may be in a helical or serpentine pattern through the void space between the screw pitch thereby further increasing the turbulent environment inside TEB 14. Since the void space between screws 18A and 18B is shared by the feed material and the vapors, further heat is transferred. The impingement zones created by the thin film regions 138 provide ideal conditions for highly enhanced heat and mass transfer between the vapor stream and the solid particles. The collisions of the solid particles also permit breakage of lumps and better thermal desorption even for multi phase feed materials. Depending upon the screw geometry, feed material composition and operating temperature and pressure, it is believed that the impingement velocity (also referred to herein as the "second" velocity) of vapors and entrained fine solids can reach 200 meters per second (m/s) in TEB 14.

Figure 6A:
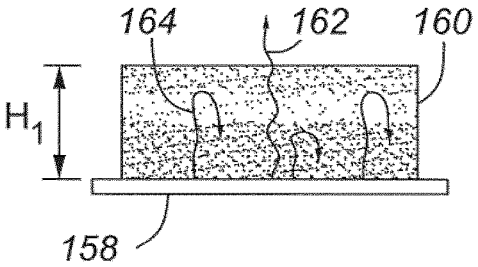
(PRIOR ART) FIG. 6A
Figure 6B:
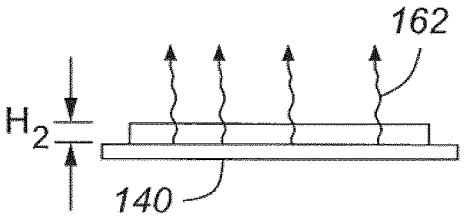
Figure 7:
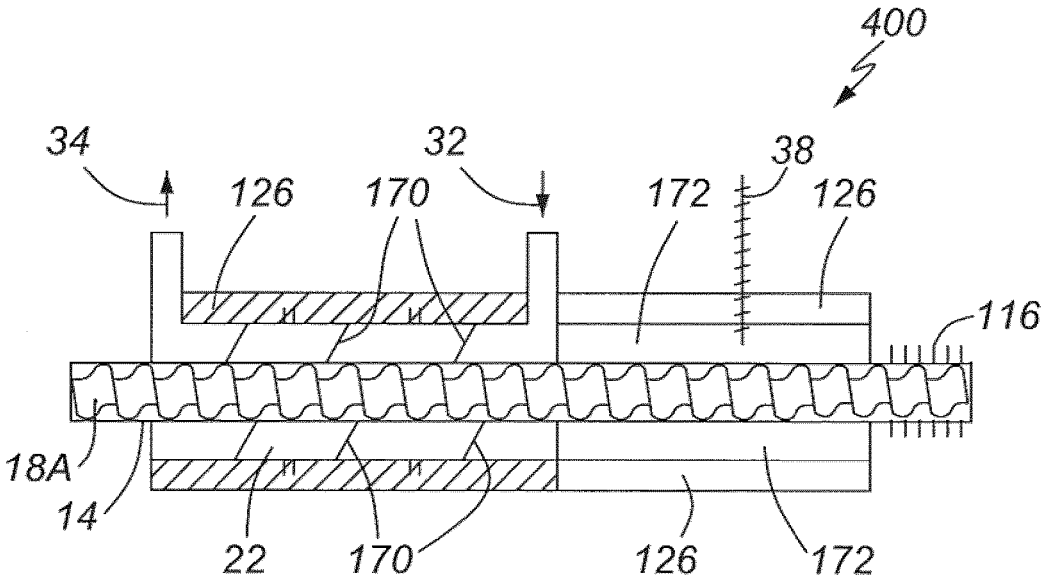
FIG. 7 is a schematic longitudinal cross-section view of another alternative embodiment of a thermal extraction unit in accordance with the present disclosure.

In certain embodiments of methods and systems of the present disclosure, screws 18A, 18B may be rotated at rates ranging from about 20 to about 200 rpm. This is in stark contrast with other thermal desorption methods such as rotary kilns, batch drums, auger in tube arrangements and hollow hot oil technologies, where rotational speeds range only from about 2 to about 10 rpm. Table 1 compares the various technologies. The low rotational speeds in the previous methods tend to result in a very large bed depth. Large bed depths may restrict the mass transfer of vapors to the head space where the vapors can be removed. In typical indirect thermal desorption processes, such as illustrated schematically in FIG. 5A (large screw 156 in auger tube 158) and FIG. 5B (rotary kiln 159), the highest temperature feed material 160 is next to the hot metal surface but quickly drops proportional to the distance $H_1$, as illustrated in FIG. 6A. Vapors 164 generated from the thermal desorption adjacent to the hot metal transfer surface are more likely to prematurely condense back into a liquid within the feed matrix 160 before reaching the head space as vapors 162. Keeping a thin bed height $H_2$ and high degree mixing, as in systems and methods of the present disclosure, and as illustrated schematically in FIG. 6B, may significantly improve mass and overall heat transfer.

TABLE 1

Comparison of Systems and Methods

| Technology | Application | Time | T (° C.) | Turbulence | Heat Source |
|---|---|---|---|---|---|
| Rotary Kiln | Solid | 30-60 min | Up to 500 | 1-2 rpm Low-med | Flue gas - diesel fuel |
| Hammer Mill | Solid | <1 min | ~300 | 600 rpm Very high | Electric or diesel fuel |
| TPS - Screw in Large Tube | Solid | 20 min | Up to 550 | 2-3 rpm Low | Flue gas - diesel fuel |
| Hot Oil | Solid & some slurry | 30-60 min | <300 | 1-2 rpm Low-med | Flue gas to hot oil - typically diesel fuel |
| Thin Film Evaporators | Only low solids slurry | <1 min | <300 | 100-150 rpm High | Flue gas to hot oil or steam - any fuel |
| TVT - Narrow gap intermeshing screws in reduced P | Solid & slurry | 40 sec Vapors: 0.1 sec | 250-500 with reduced P | 20-200 rpm High | Electric, hot oil, flue gas, induction - line power or diesel fuel for generator |

Methods and systems in accordance with the present invention also employ increased temperature, achieved using various heating methods. Thermal desorption is a well understood process used for the treatment of hydrocarbon contaminated soil and high solids laden sludges. These materials are heated so that the vapor pressure of the liquid components result in the volatilization and separation of the liquid phase from the solid phase. Where the recovery of the hydrocarbons is important, the heating may be applied indirectly to the extraction chamber. The TVT process utilizes thermal desorption principals where the extraction chamber may comprise one or more barrel or casing sections made of metal with moderate structural strength that is balanced with high thermal conductivity such as many types of hardened carbon steel. As previously stated, external heating of TEB 14 may be generated via multiple methods ranging from hot oil jacket, combustion flue gases, infrared heating, induction heating, exhaust from electrical generator or electrical resistance heating.

Since the TVT technology utilizes energy for the process, certain embodiments may incorporate several unique energy efficient designs. In certain embodiments, heat may be generated both internally in TEB 14 and provided externally to TEB 14. Internal heat may be generated from friction created from the particle on particle and particle on screw/casing interaction from the very high shear environment in TEB 14. External heat may be transferred indirectly through a conductive metal of TEB 14, as illustrated schematically in FIG. 7. The TVT technology may utilize many different types of external energy sources whichever is applicable to the particular embodiment. External heating of TEB 14 may be generated via multiple methods, ranging from hot oil jacket, combustion flue gases, infrared heating, induction heating, exhaust from electrical generator, electrical resistance heating, and combinations of these. For example, in areas where open flames are prohibited or undesirable, electrical energy can be used to indirectly heat TEB 14. In other areas hot oil or combustion gases may be used to transfer heat to TEB 14. Of particular benefit is the use of induction heating to heat TEB 14, as in embodiment 400 illustrated in FIG. 7. High heat flux may be achieved with electrical resistance heating and particularly with induction heating at rates of about 20 W/cm$^2$ and greater, using power supplied via one or more cables 38 from electrical generator 28 (FIG. 1) or other electric power source, connected to one or more heat applicator heads 172, such as electric ceramic band heating elements. High heat flux rates allow for a more compact thermal extraction unit 2 and lower screw L/D ratio (where "L" is length of the screw, and D is equal to "D1" defined FIG. 9) resulting in lower capital expenses, smaller foot print and lower operating costs. Induction heat is beneficial because it may be made very compact, with fast response time, more accurate temperature control and high frequency voltage generators employed may be located away from the heat applicator head(s) providing greater flexibility in various embodiments. Multiple heads could be placed along the length of TEB 14 and through control logic, heat applicator heads 172 could be instructed to provide heat as required based on thermocouples located throughout TEB 14. A single heat applicator head 172 could also be made to travel the length of TEB 14 providing heat wherever required through a similar control logic. Induction minimizes heat loss to the environment because the heat is concentrated to TEB 14 and substantially nowhere else. This can be very beneficial to locating systems of this disclosure in offshore applications or other zoned environments.

Referring again to FIG. 7, certain embodiments easily allow for multiple combination methods of heating TEB 14, such as flue gases and electrical heating. This is desirable particularly when a diesel electrical generator 28 is used, as illustrated in FIG. 1. Generator exhaust flue gas, which typically exits at temperatures ranging from about 500° C. to about 550° C., may be used to partially heat TEB 14 by routing generator exhaust gases through conduit 32, through annulus 22, and exit annulus 22 through conduit 34 at outlet temperatures ranging from about 150° C. or to the minimum desired operating temperature. The length of the flue gas heating section may be increased or decreased according to the desired exit temperature. The flue gas section of TEB 14 may be designed with annulus 22 having one or more baffles 170 to maximize turbulence and minimize short-circuiting. In addition, fins could be added (not shown) to improve convective heat transfer to TEB 14. The direction of the exhaust flue gas can be either countercurrent, co-current, or cross-flow to the direction of the oil based slurry in TEB 14. For greater flexibility to set the appropriate operating temperature, in certain embodiments annulus 22 may be manufactured in one or more sections, each section having a length ranging from about 1D to about 4D, which could be key lock or flanged together. Results from pilot testing are provided further in the Examples section herein.

Regarding residence time, there are two residence times that must be considered for methods and systems in accordance with the present disclosure. First, the residence time of the feed material through the heating process and second, the residence time of the desorbed vapors.

In certain embodiments, a certain residence time is desired to allow for the slurry to be heated to the minimum temperature so that full or substantially full desorption of the volatile components may occur resulting in a substantially dry solid material. However, the residence time should be minimized to prevent or substantially reduce contact with heated surfaces at elevated temperatures. Longer residence times of the feed material may lead to hydrocarbon cracking and generation of non-condensable byproducts. Residence time may be dictated by the screw configuration (flight depth, pitch and flight width plus the rotation speed of screws 18A, 18B). The ideal residence time of the feed material in TEB 14 may be determined by the rate of heat transfer, which may be determined by overall heat transfer coefficient, operating temperature and surface area. Since it is desirable to minimize residence time of the feed material, in most embodiments improvement of the overall heat transfer coefficient is desired. Increasing the temperature in TEB 14 may result in hydrocarbon cracking which may render the recovered hydrocarbons useless. Increasing surface area of TEB 14 is possible but increases thermal extraction unit footprint, and may increase capital and operating costs. For a given screw configuration, increasing the rotational speed of the screws may reduce residence time of feed material, but too high rotational speed may result in lower amount of mixing which may lead to lower overall heat transfer coefficient and poor heat and mass transfer. A very low rotational speed may also result in the same undesirable outcomes. From testing, it has been determined that a residence time ranging from about 20 to about 300 seconds may be achieved with rotational speeds ranging from about 20 to about 200 rpm for a uniform pitch ranging from about 0.2 to about 1.0 D, constant shaft diameter of D/d ranging from about 1.1 to about 1.8 and constant flight angle ranging from about 5 to about 30 degrees with a flight width equal to 0.5 pitch, where D is diameter of the screw and d is diameter of shaft.

A typical emulsified slurry feed may contain water and multiple hydrocarbons. As the slurry is heated in TEB 14, temperature increases, pressure is reduced, and turbulence increases through TEB 14, and liquids are volatilized as in order of their particular boiling point/vapor pressure. The maximum temperature is reached at the discharge end of TEB 14, however various vapors may be generated throughout TEB 14. To promote minimum residence time, multiple vent zones may be installed on TEB 14. Ideally, the number and location of the vent zones may be determined to remove vapors as soon as the vapors are generated. For example, while feeding a slurry containing oil/water/solids, in embodiment 300 illustrated schematically in FIG. 3, steam may be removed from TEB 14 in advance and relatively close proximity to the feed location through vent tube 125, while the hydrocarbon vapors may be removed at or near the discharge end of TEB 14 in tube 128. In addition to multiple vent zones, an applied vacuum on TEB 14 further reduces residence time. As illustrated schematically in FIG. 8, it is believed that vapors 152 are allowed to travel along the head space 180 through the open cavities within intermeshing screws 18A, 18B and the gap between screw elements and inside surfaces 140, 141 of TEB 14.

As noted herein, in methods and systems of the present disclosure, the desired solids residence time ranges from about 20 to about 300 seconds. Pilot tests have been successfully conducted with solids residence times of 30, 60 and 90 seconds with screw configurations and operating conditions as described in Table 2. This is in stark contrast with other thermal desorption methods such as rotary kilns, batch drum, auger in tube and hollow hot oil technologies where low rotational speeds result in high residence times that range from about 20 to about 60 minutes. The long residence times result in greater contact of feed material with the heating surface that may result in cracking of hydrocarbons and oil contamination. Therefore, the shortest possible residence time is desired for both the feed slurry and desorbed vapors. The residence time of the vapors in methods and systems of the present disclosure is very short, and may range from about 0.01 to about 5 seconds, or from about 0.01 to about 1 second, or from about 0.01 second to about 0.3 second.

Figure 8:
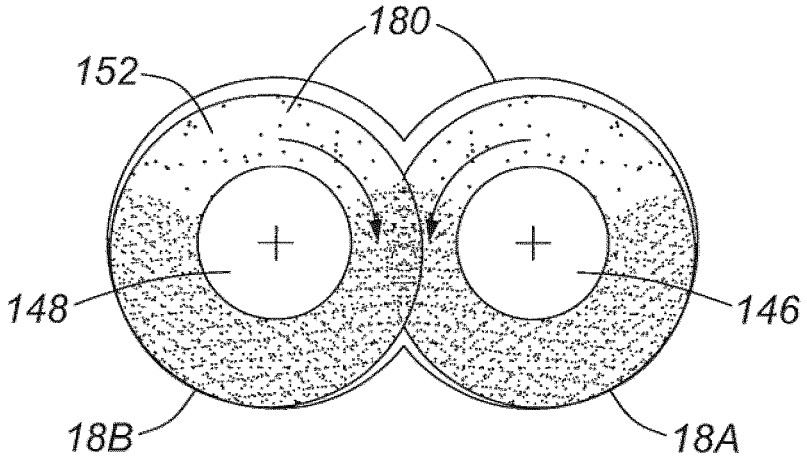
FIG. 8 is a schematic end elevation view of vapor spaces believed to be formed in one set of intermeshing screws suitable for use in methods and systems of the present disclosure.

The screw geometry plays an important role in methods and systems of the present disclosure. Screw geometry largely determines residence times of the feed material and vapors, amount of mixing, level of self cleaning, flow pattern of fluids, semi-solid and solid material through TEB 14. For clarity, screw geometry and terminology is provided in FIG. 9. Many different screw geometries are suitable for use in methods and systems of the present disclosure. In the main, the primary functions of the screw geometry are to convey all types of solid and fluid material, including viscous and viscoplastic; overcome changing properties while conveying; promote mixing; create a "thin layer" or "thin film"; generate and transfer frictional heating; provide a pathway for desorbed vapors; and be self-cleaning. These objectives can be accomplished with a twin-screw design. Significant testing for the TVT process was conducted with modular intermeshing counter-rotating twin screws (in other words, the screws rotate in the opposite direction, but the meshing flights pass each other in same directions, as illustrated schematically in FIG. 8. A counter-rotating pair of twin-screws could also function in a similar manner (as illustrated schematically in FIG. 4). Multiple screws positioned in an adjacent manner in TEB 14 could also be utilized in certain embodiments, although casing surface area for heat transfer is reduced. FIG. 8 illustrates arrows pointing towards each other thereby suggesting that the screws are counter rotating. If the arrows were pointing away from each other, they would still be counter rotating. However, the screws can operate in a co-rotating manner in either clockwise or counter-clockwise manner.

The TVT Pilot Unit had a TEB 14 inside diameter of 34 mm and inter-screw distance Dg of 0.25 mm. The ratio of length to diameter (L/D) was about 28.23. The general specifications of the equipment are given in Table 2.

TABLE 2

| Pilot Unit Specifications | |
|---|---|
| Screw Diameter D | D 33-34 mm |
| Inter-Screw Gap Distance | <1 mm |
| Screw Length | 30 D<br>990 mm |
| Screw Speed | 10-300 rpm |
| Drive Power | 7.5 kW at 300 rpm |
| Max. Torque | 2 · 123 Nm |
| Heating Power Per Zone | 500-1800 W |
| Heating zones | 6 |
| Output Rate Depending Specific Energy of Consumption based on material type. | 3-50 kg/hr |
| Barrel Diameter | 34 mm |
| Metallurgy - shaft | Hardened steel 4140<br>Shear modulus: 79 GPa |
| Metallurgy - barrel and screw elements | chromium-molybdenum steel alloys |
| Clearance between Screw Flights and Barrel | <0.5 mm |
| Channel Depth (flight depth) | 4.2 mm |
| Helix angle | Fixed 79 degrees |
| Flight Width | Fixed 9.10 mm |
| Channel Width | Fixed 10.50 mm |

The overall length "L" of screws 18A, 18B and the resulting surface area is dependent upon the feed rate (kg/hr), feed material composition and resulting specific energy of consumption (W hr/kg), operating temperature (K) and overall heat transfer coefficient ($W/m^2$ K). During testing, the overall heat transfer coefficient was determined to be greater than 90 $W/m^2$ K for a wide range feed compositions, screw RPM and feed rates. For a given feed rate with varying composition (specific energy of consumption) operating at certain temperature, the appropriate L/D ratio may be determined. However, practically the L/D ratio is fixed in any design while the remaining operating parameters are temperature and feed rate. Since it is typically desirable to maximize feed rate, the operating temperature of the heaters may be set at such a temperature so as not promote cracking of hydrocarbons. Therefore, L/D ratio should be as high as possible and only limited by a torque limitation on the screws and velocity of the desorbed vapors. For feed materials with high solids content, torque may be higher than those materials with lower solids and higher liquid content, particularly as higher oil content may act as a lubricant. For example, for slurries with specific energy of consumption 200 W hr/kg or greater operating at 700 K, a L/D ratio of 30 or more may be desirable.

Figure 9:
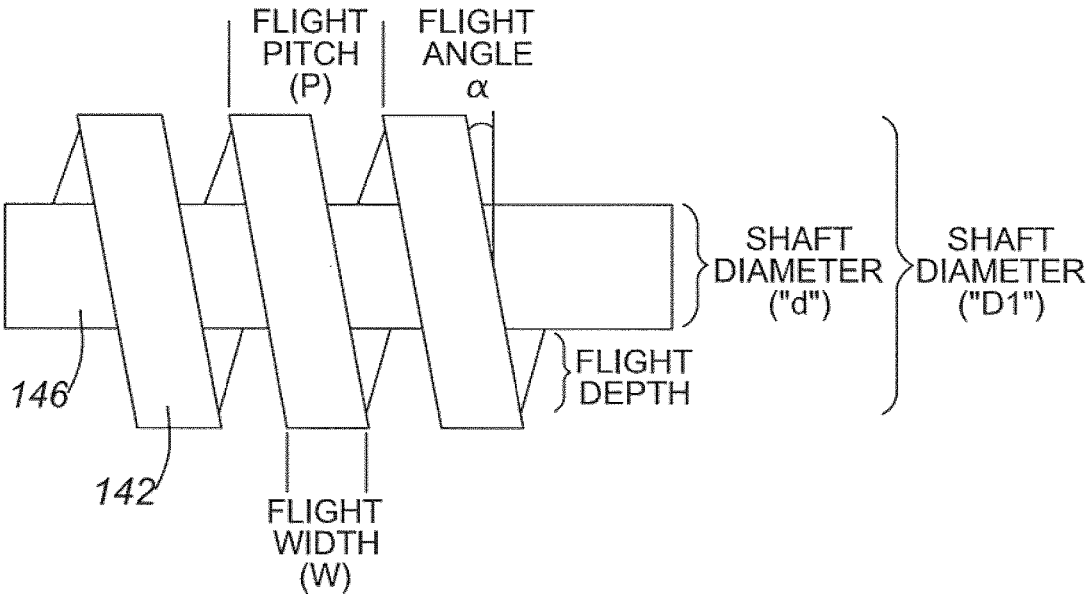
FIG. 9 is a schematic side elevation view of a portion of a screw suitable for use in methods and systems of the present disclosure, illustrating nomenclature used in describing such screws.

Due to the high torque generated from the frictional resistance of material in the screws and TEB 14, and using the terminology of FIG. 9, the shaft diameter "d" should relate to the screw diameter "D1" with a ratio of D/d greater than about 1.3 depending upon the metallurgy selected (higher strength material with high shear modulus may allow for higher D1/d ratios), rotational speed of the screw (higher screw speed may allow for higher D1/d ratio due to lower torque requirement) and type of feed material (lower solids content feed material may allow for higher D1/d ratio), the resulting torque may create conditions of unacceptable torsional deflection. A D1/d ratio of greater than about 1.3 may provide sufficient flight depth and sufficient volume for the conveyance of feed and solid material. In addition, D1/d ratios greater than about 1.3 may also provide a sufficient path for desorbed vapors. It was determined that flight angle "α" values ranging from about 5 degrees to about 15 degrees provided ideal conveying in certain embodiments, although higher or lower values may be operative as well, for example, up to 25 degrees, or down to 2 or 3 degrees. Flight width "W" may range from about 5 mm to about 200 mm, while flight depth "$F_d$" may range from about 15 mm to about 300 mm.

Due to the nature of the feed slurry materials processable by method and systems of the present disclosure, it may be desired to convey material through TEB 14 in a plug flow regime. The screw and barrel geometry in these embodiments ensures minimal backward flow of material, substantially constant velocity of the material and substantially reduces or eliminates solid material build up on the screws and insides surface of TEB 14. In addition, there is little or no radial thrust transferred to the screw shaft as viscosity increases during the thermal desorption process where feed material transitions in TEB 14 from high liquid content at the entrance to TEB 14 to no liquid content near the discharge end of TEB 14, or when the feed material itself is very viscous.

Materials of construction of TEB 14 and screws 18A, 18B, 18C, and 18D are generally metallic, although ceramic, composite, or metal-coated materials may be envisioned, as long as they have comparable mechanical and physical properties of comparable metals. For example, screw shafts 146, 148 may be comprised of chromium-molybdenum steel alloys, such as 4140 through-hardened steel. Screw elements 142, 144 may comprise composite materials, for example powder-metallurgically-bonded materials with a Rockwell C hardness ("HRC") of about 60 or above with an operating temperature of 450° C., or through-hardened steels which provide excellent wear resistance. TEB 14 may comprise a base barrel with a replaceable liner made of a hard, through-hardened cast chromium steel with a liner hardness (HRC) of about 57 or above; or a one piece HIP (hot isostatic pressing) replaceable liner comprising NiCrBSi with carbides, and through-hardened; or one piece solid barrel (direct coating) using a brazed hard material layer comprising carbides dispersed in an NiCrB matrix with a hardness (HRC) of about 62 or above and coating thickness ranging from about 1 to about 3 mm.

Figure 10:
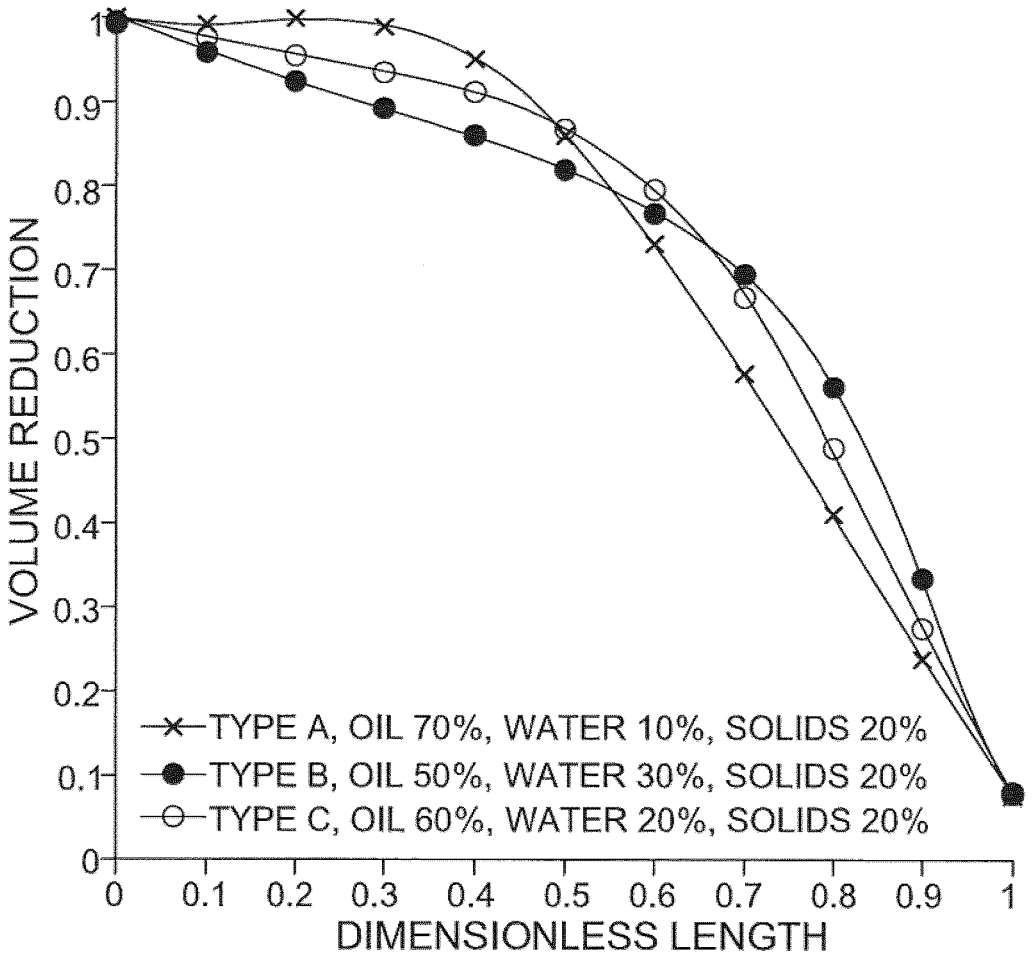
FIG. 10 is a graph illustrating the relationship of feed composition volume reduction to length of screws useful in methods and systems of the present disclosure.
Figure 11A:
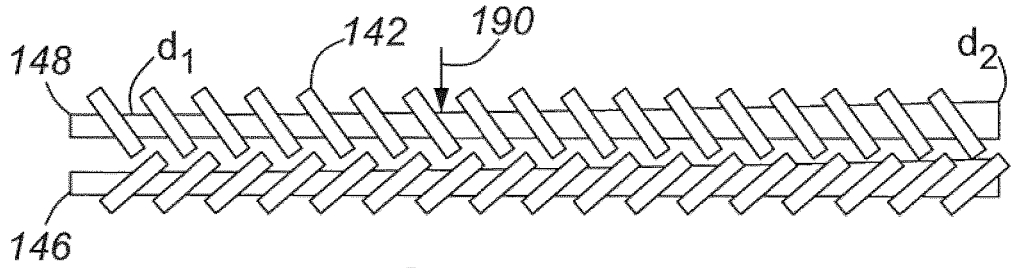
FIGS. 11A, 11B, and 11C are schematic plan views of three pairs of screws that may be useful in practicing methods and systems of the present disclosure.
Figure 11B:
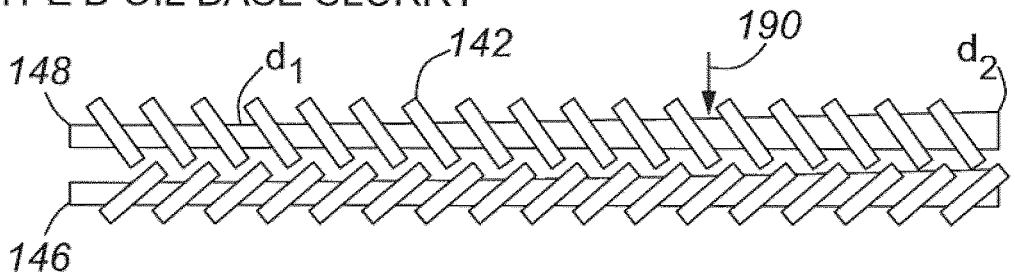
Figure 11C:
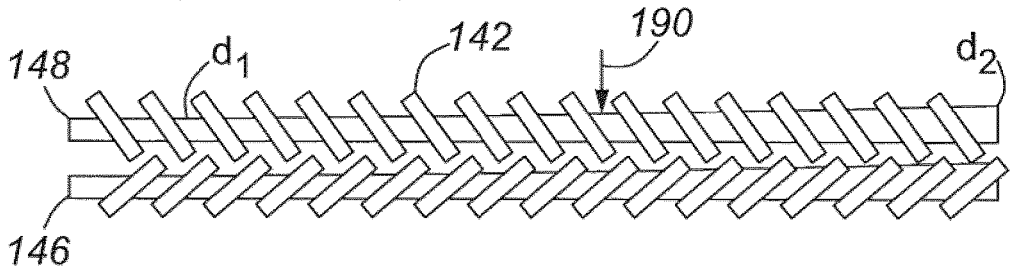

As should be apparent, the slurry material feed to TEB 14 may significantly change in properties as the liquid is desorbed. There may be a significant volume reduction based on the amount of liquid and solids in the feed composition. However, the approximate location of where the liquid is fully desorbed depends upon the specific energy of consumption, which is largely determined by the water component of the liquid portion of the feed slurry material. For example, higher water content may require more energy and therefore may require more surface area or lineal length of TEB 14. Since the maximum energy capacity of a given system is fixed, the location where the liquids are fully desorbed may shift closer or further away from the feed end of TEB 14. FIG. 10 illustrates graphically where the most significant volume reduction occurs based on three types of slurry feed compositions. The solids content was fixed for all three slurries to reflect the same volume reduction for illustration purposes. With all three slurries having the same volume reduction, the graphs reflect three different positions of where the most significant volume reduction occurred from thermal desorption. Therefore, in order keep a constant ratio of the cross sectional for the desorbed vapors to travel along the helical path of the screws 18A, 18B and exit TEB 14, the D1/d ratio of the screws may be made variable along the length of the screws, as illustrated schematically in FIGS. 11A, 11B, and 11C. FIG. 11A illustrates a typical screw geometry suitable for use with a feed slurry such as an oil-based slurry comprising 70 percent oil, 10 percent water, and 20 percent solids; FIG. 11B illustrates a typical screw geometry suitable for use with a feed slurry such as an oil-based slurry comprising 50 percent oil, 30 percent water, and 20 percent solids; and FIG. 11C illustrates a typical screw geometry suitable for use with a feed slurry such as an oil-based slurry comprising 60 percent oil, 20 percent water, and 20 percent solids. The variable D1/d ratio, starting with a larger ratio and ending with a lower ratio also has the added benefit of increasing the maximum torque limitation. Arrow 190 indicates the point where the D1/d ratio begins to change in each figure. The ratio of final shaft diameter "$d_2$" to initial shaft diameter "$d_1$" may range from about 1.1 to about 1.95.

Figure 12:
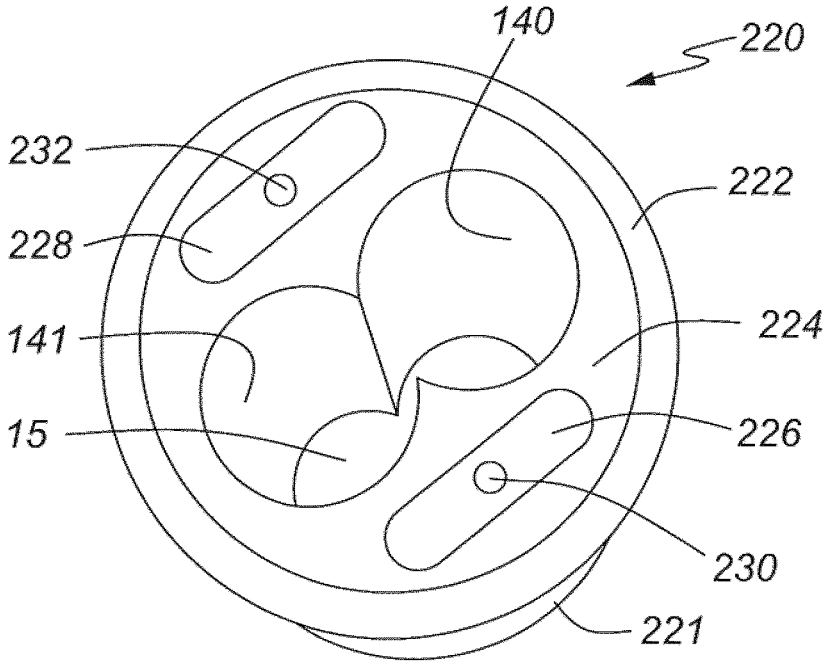
FIGS. 12 and 13 are schematic end and side perspective views, respectfully, of a casing section that can be used in a pilot unit used to test the disclosed methods.
Figure 13:
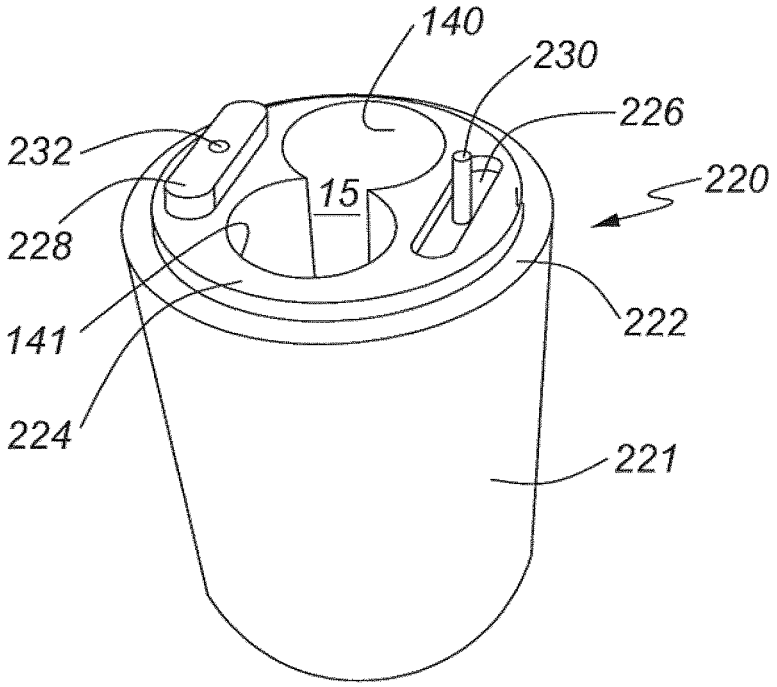

FIGS. 12 and 13 are schematic end and side perspective views, respectfully, of a casing section 220 (section of TEB 14) like that used in a pilot unit used to test various embodiments of methods and systems of the present disclosure. Casing section 220 comprised a metallic body 221 having a diameter of 90 mm and length of 110 mm. Casing section 220 also had a lip portion 222 and a raised end area or end region 224 that was raised 5 mm above lip 22, having a recessed connector portion 226 on one side of raised end region 224, and a raised connector portion 228 on the opposite side of raised end region 224. Connector portion 228 had a length of 37 mm, and a width of 10 mm. A connector pin 230 projects from and above recessed connector portion 226, and a connector aperture 232 is provided in raised connector portion 228 to accommodate a mating connector pin from another casing section. Also illustrated are internal surfaces 140, 141 of casing section 220, and internal chamber 15 as discussed herein. Each sub-chamber defined by surface 140, 141 had a radius of 17.2 mm.

Figure 14:
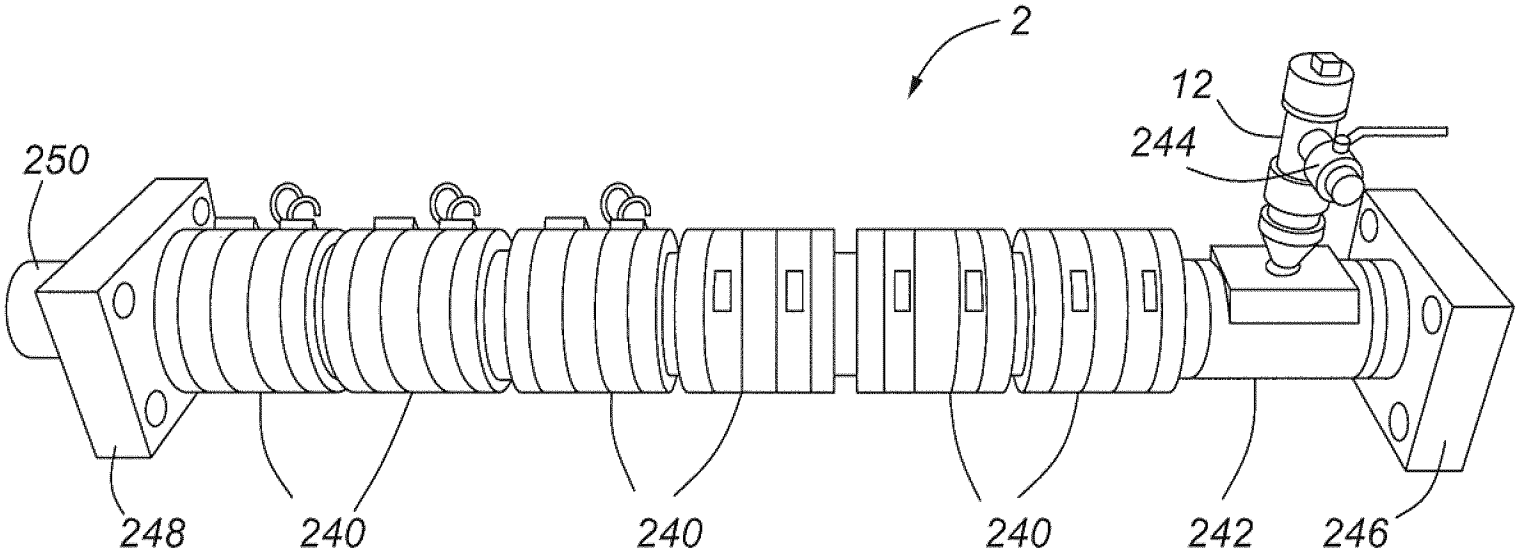
FIG. 14 is a schematic side perspective view of a heated casing employing six casing sections like that illustrated in FIGS. 12 and 13 and used in the pilot unit.

FIG. 14 is a schematic side perspective view of a heated casing or TEB 14 employing six heated casing sections 220 like that illustrated in FIGS. 12 and 13 and used in the pilot unit. Illustrated schematically are six ceramic band heating elements 240. The feed inlet 12 is illustrated attached to a feed section 242 not unlike sections 220, except feed section 242 was shaped to accommodate inlet connector 12 and a valve 244. A feed end plate 246 and discharge end plate 248 near discharge end 250 were also provided.

Figure 15A:
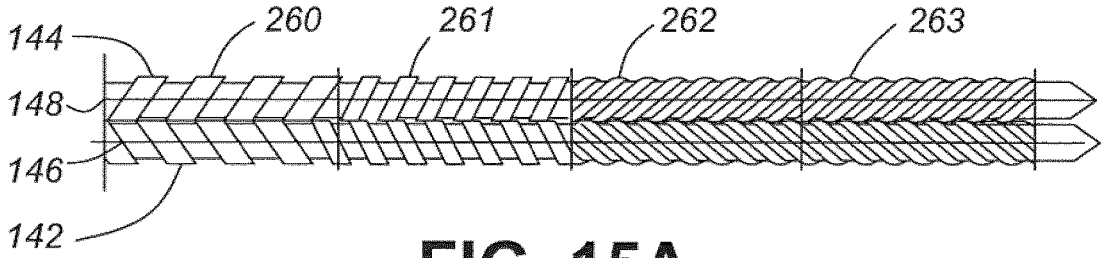
FIGS. 15A-D are schematic plan views of different screws and screw sections tested in the pilot unit.
Figure 15B:
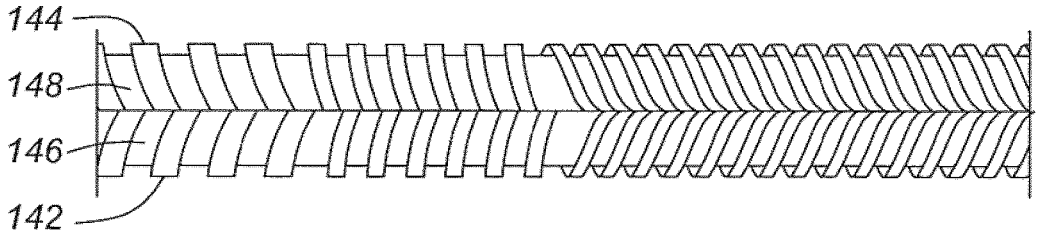
Figure 15C:
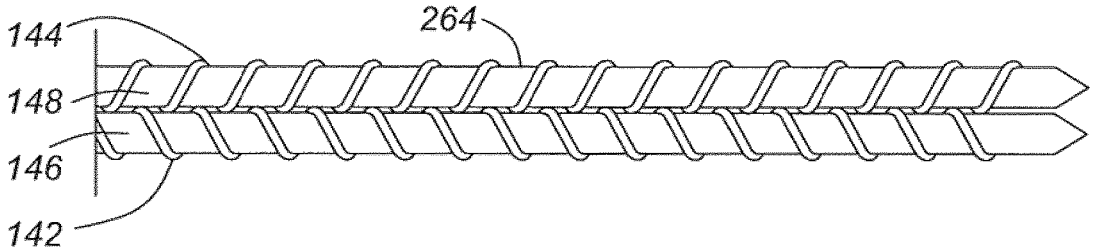
Figure 15D:
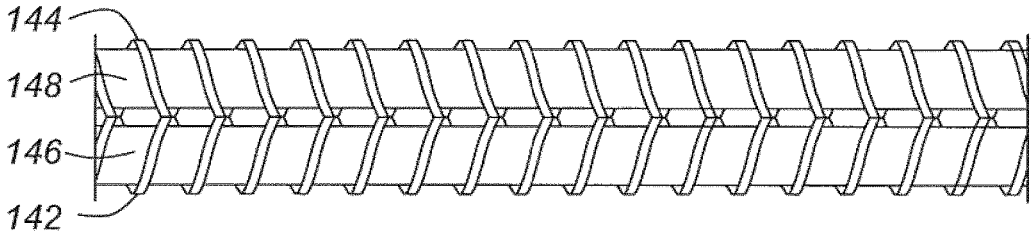
Figure 16A:
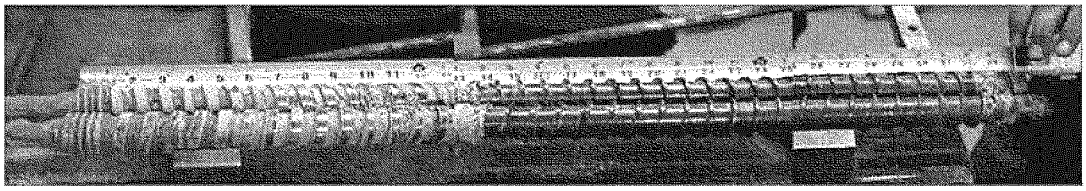
FIGS. 16A, 16B, 16C, 17A, 17B, 18A, and 18B are photographs of screws and screw sections after use in the pilot unit.
Figure 16B:
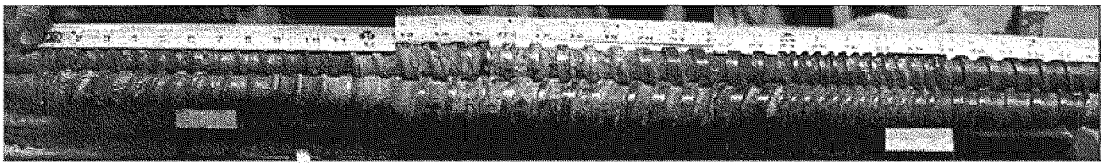
Figure 16C:
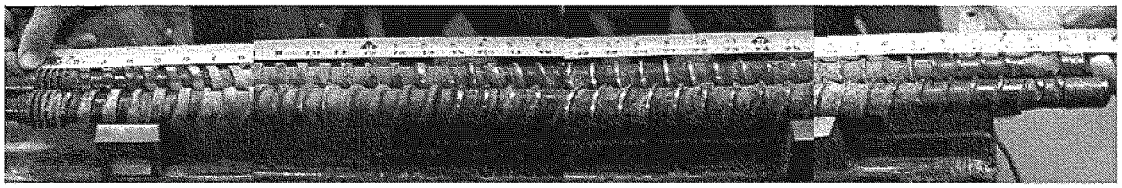
Figure 17A:
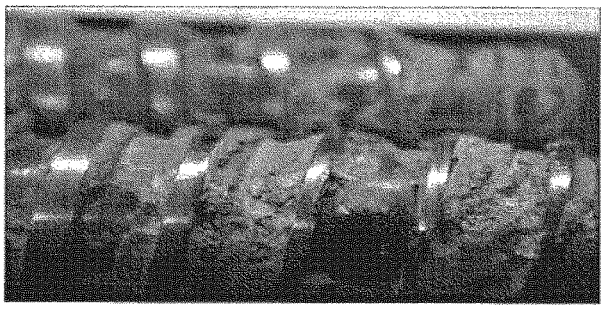
Figure 17B:
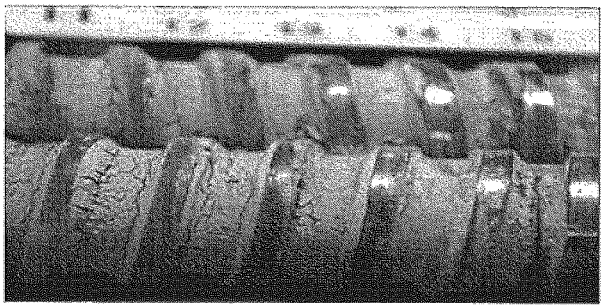
Figure 18A:
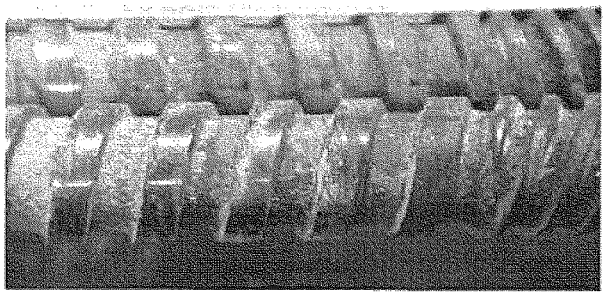
Figure 18B:
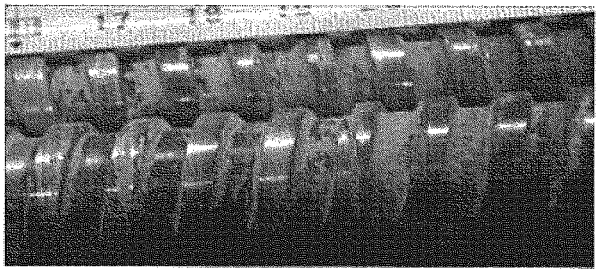

FIGS. 15A-D are schematic plan views of different screws and screw sections tested in the pilot unit. Illustrated in FIG. 15A are four different "FD" sections 260, 261, 262, and 263, while FIG. 15C illustrates "FF" sections 264, as will be explained herein. FIGS. 16A, 16B, 16C, 17A, 17B, 18A, and 18B are photographs of screws and screw sections after use in the pilot unit.

Figure 19:
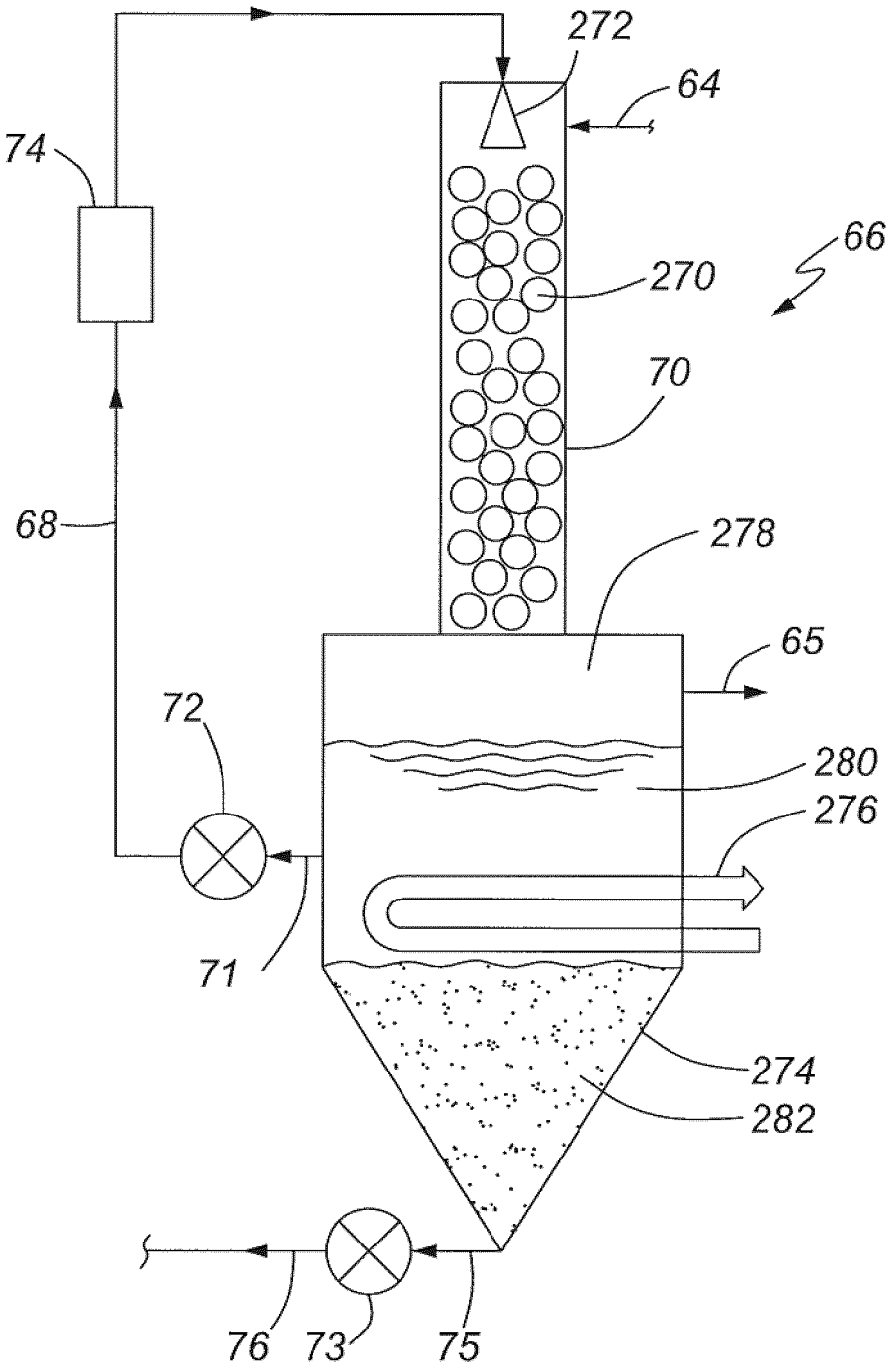
FIG. 19 is a schematic side elevation view, partially in cross-section, of an oil scrubbing unit that may be useful in certain method and system embodiments of the present disclosure.

FIG. 19 is a schematic side elevation view, partially in cross-section, of an oil scrubbing unit 66 that may be useful in certain method and system embodiments of the present disclosure. Illustrated schematically is upper section 70 containing a plurality of glass beads or spheres 270, which could easily have been any packed media, as discussed herein. Upper section 70 received flow at its top through conduit 68 and oil circulation pump 72, the latter fed through a conduit 71 taking off liquid oil 280 from a middle portion of a conical bottomed vessel 274. Solids and/or sludge 282 accumulate in the conical section of vessel 274, and are removed therefrom through conduit 75 using sludge pump 73 and conduit 76, which routes the sludge to the thermal extraction unit, 2, as explained earlier herein. A heating and/or cooling coil 276 may be provided. Hydrocarbon vapors 278 free of solids including ultra fines are removed via conduit 65, also as previously explained. It should be noted that pump 72 must be able to overcome the vacuum pressure created by the primary eductor 48. For oil to flow into the inlet port of UFS pump 72, it has to overcome the 25 inch Hg to 29 inch Hg (85 to 98 kPa) of vacuum the UFS vessel 66 is under. To do this, the vacuum created by UFS pump 72, plus the pressure head of the oil in UFS vessel 66, combine to overcome the vacuum created by primary eductor 48. Because the vacuum of UFS pump 72 is fixed, the only variable is the pressure head from UFS vessel 66. Maximizing physical separation between UFS pump 72 and UFS vessel 66 creates the head necessary, combined with UFS pump 72 vacuum, for oil to flow into the inlet port of UFS pump 72.

Figure 20:
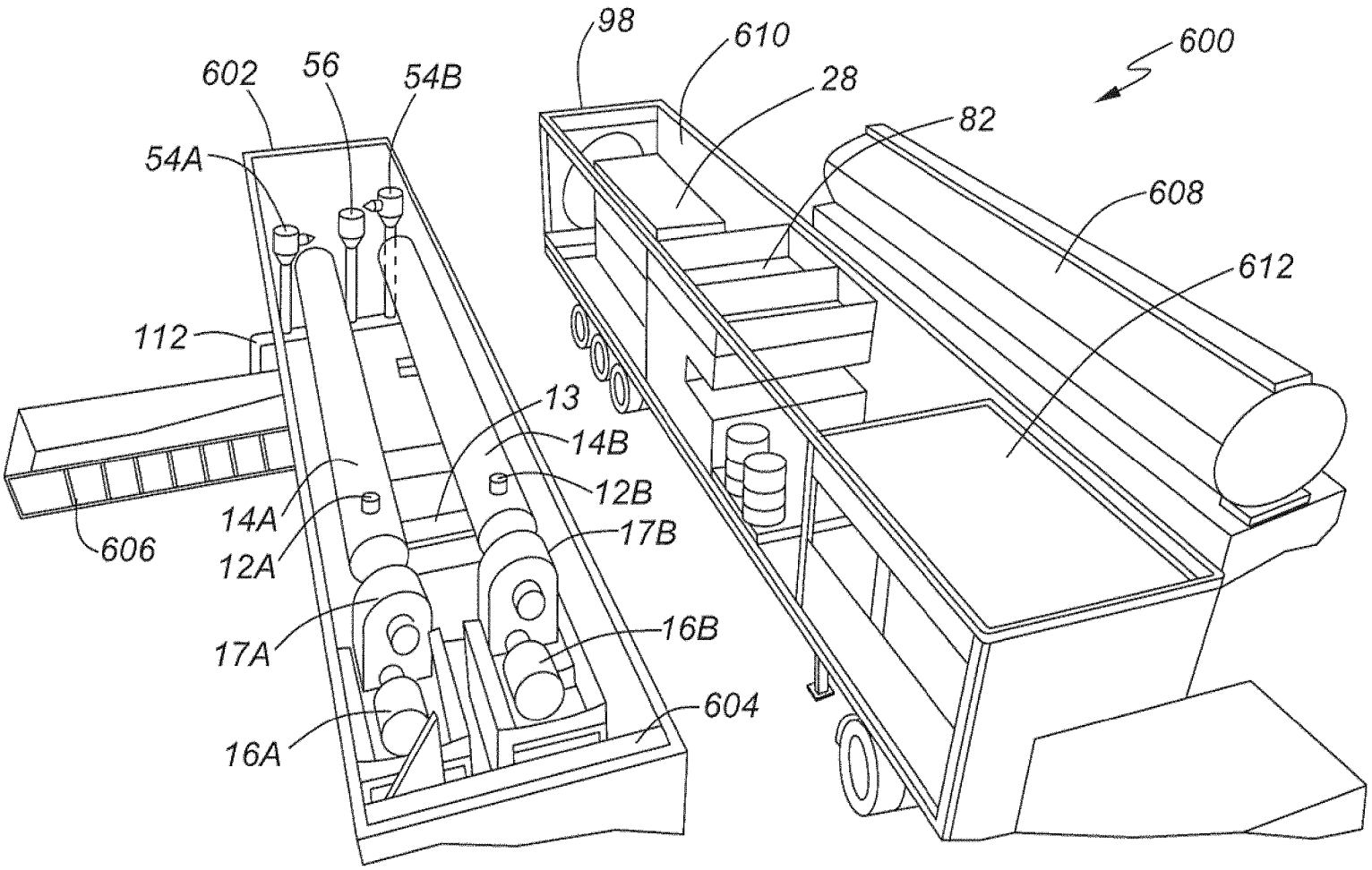
FIG. 20 is a schematic perspective view of a truck-mounted system in accordance with the present disclosure.
Figure 21A:
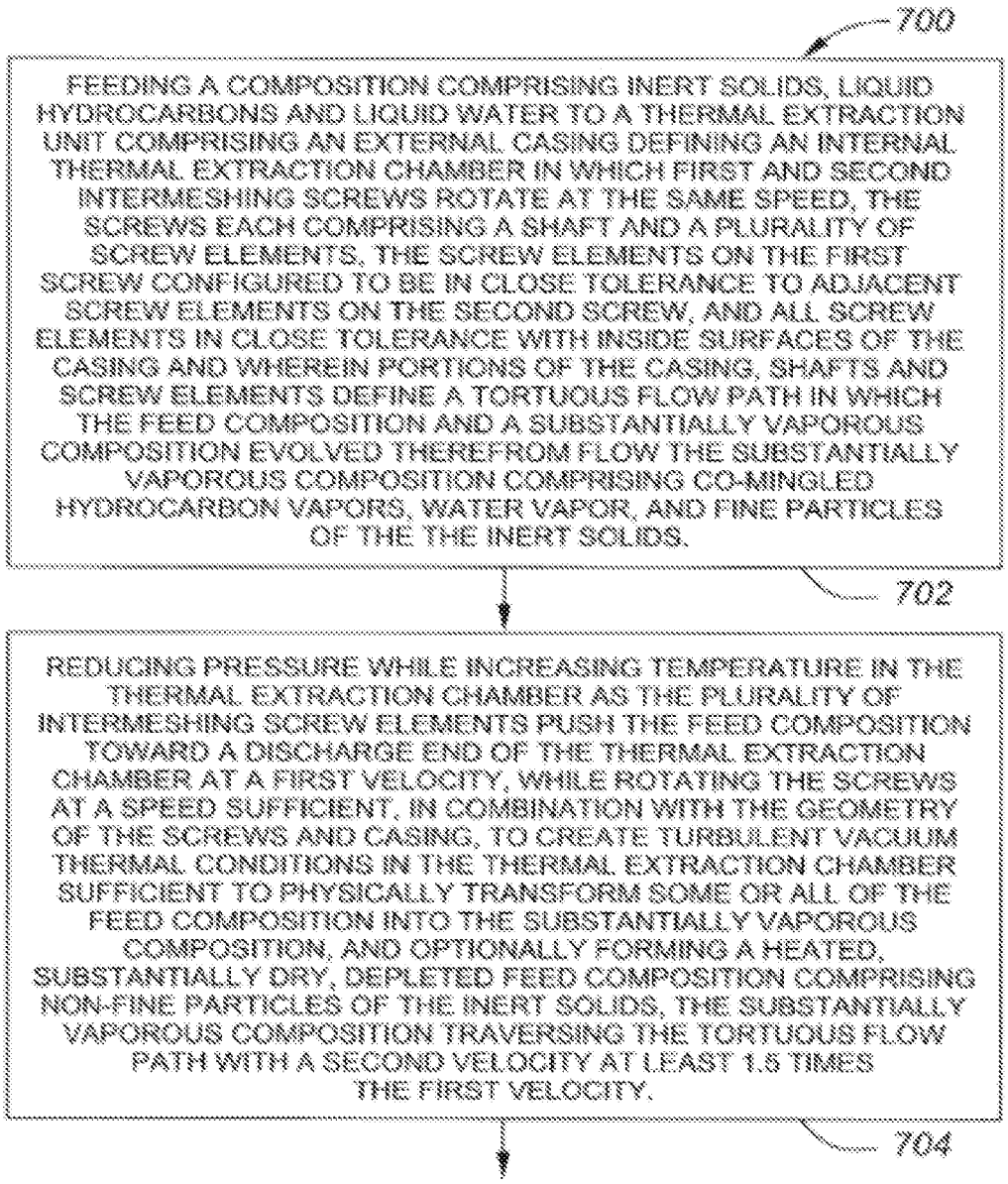
FIGS. 21A, 21B, 22A, 22B, and 22C are logic diagrams of two methods in accordance with the present disclosure.
Figure 21B:
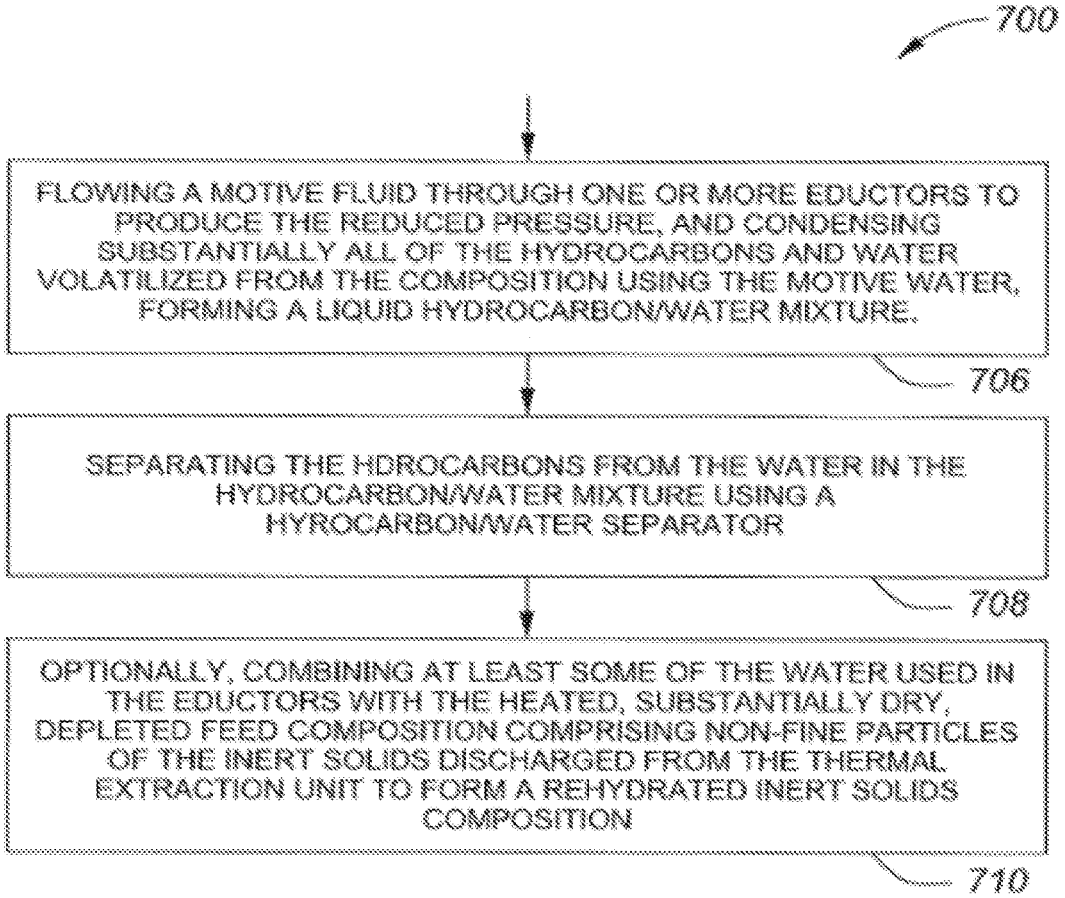
Figure 22A:
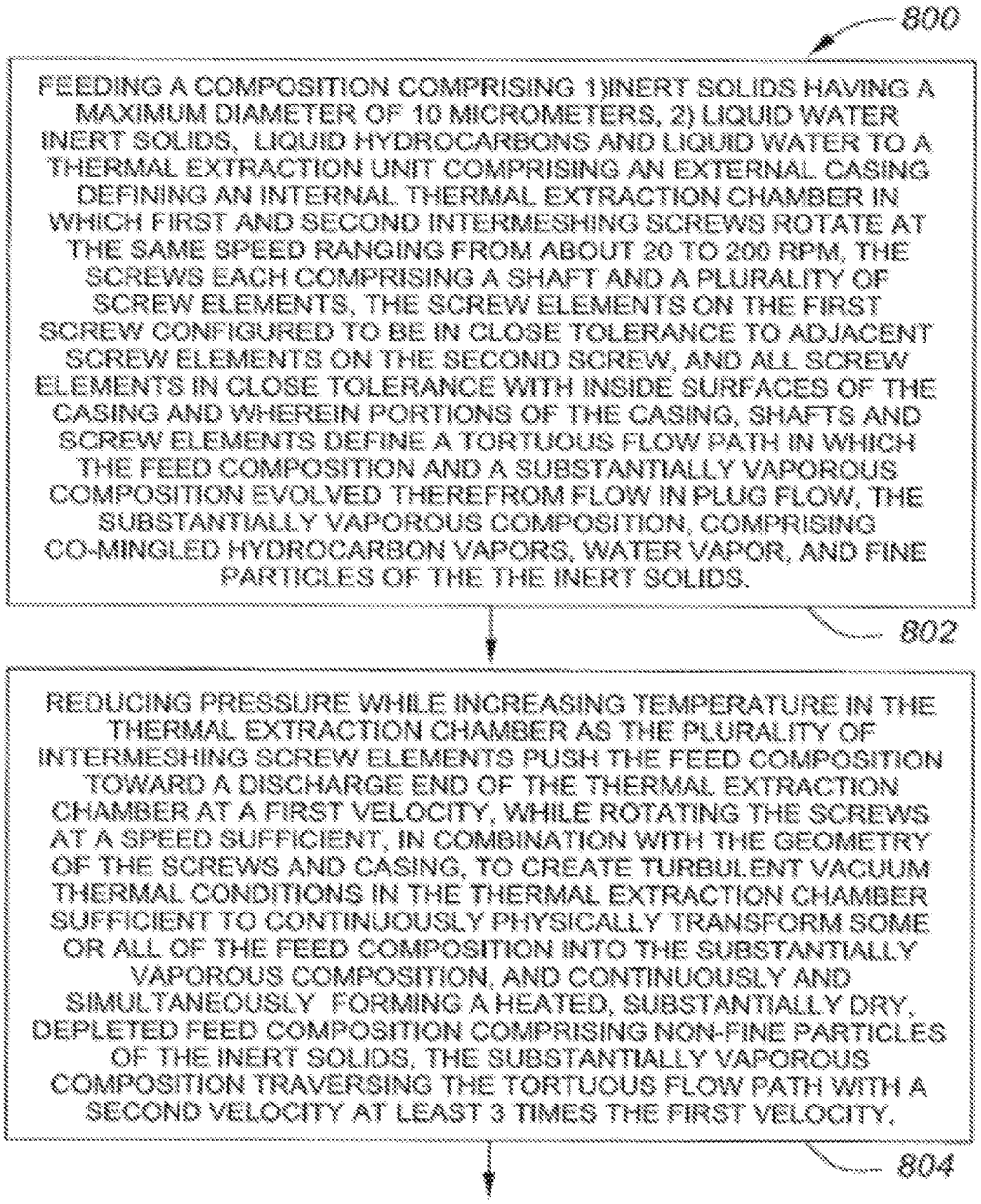
Figure 22B:
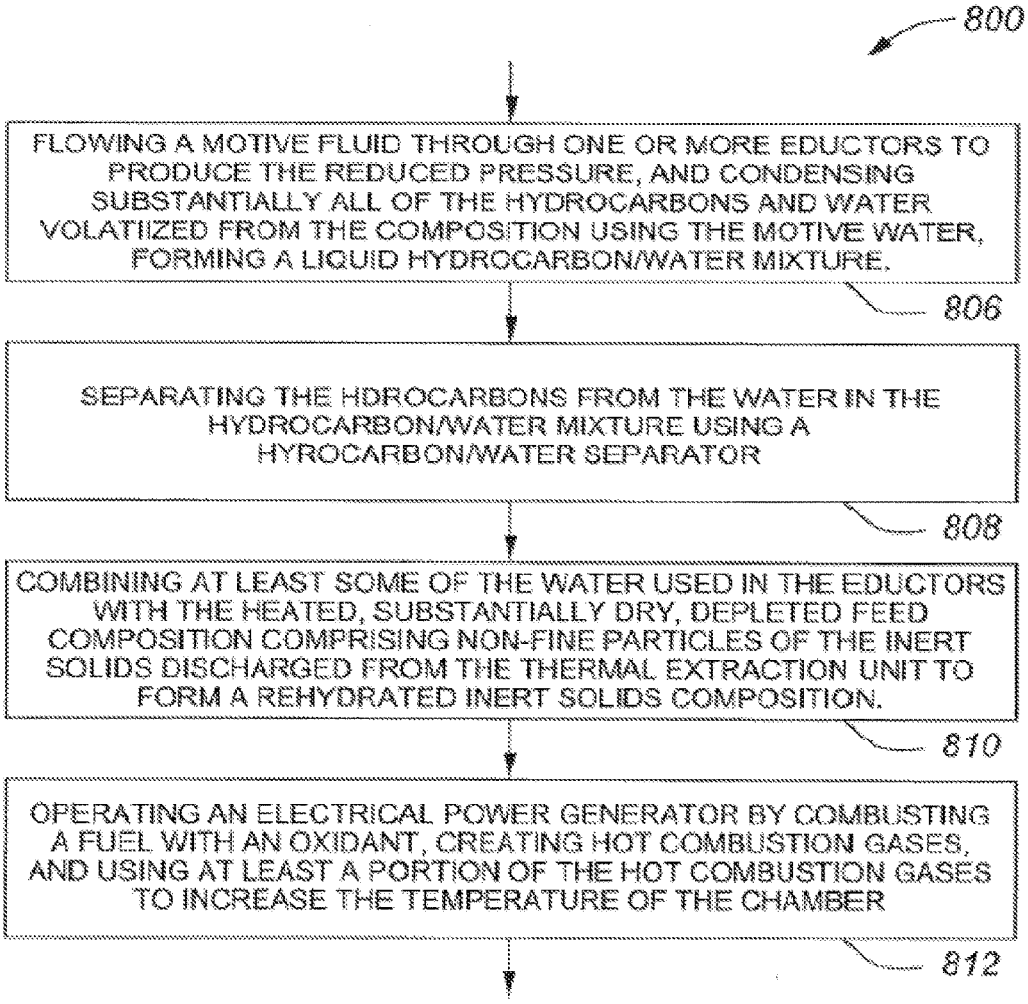
Figure 22C:
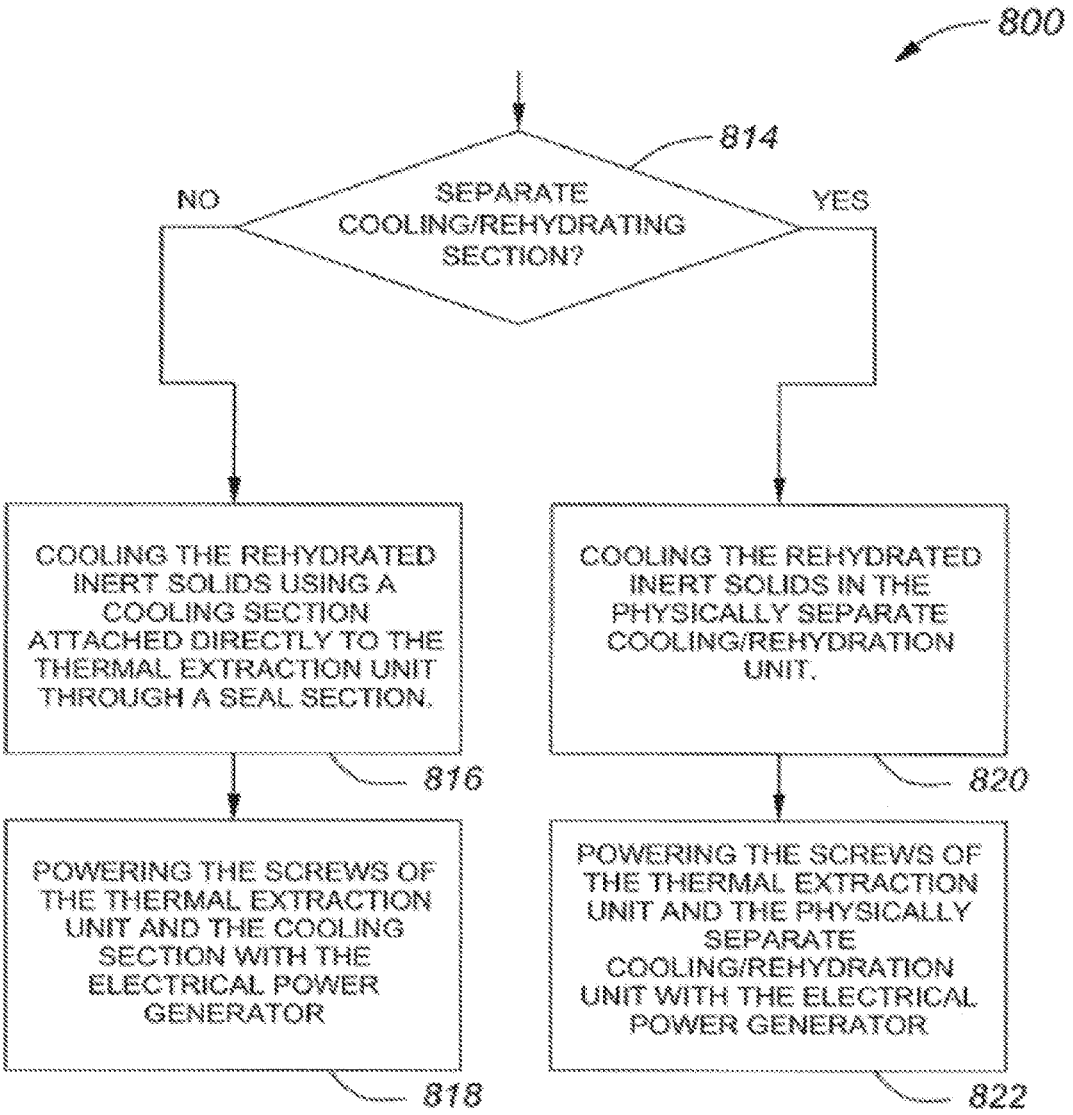
Figure 23:
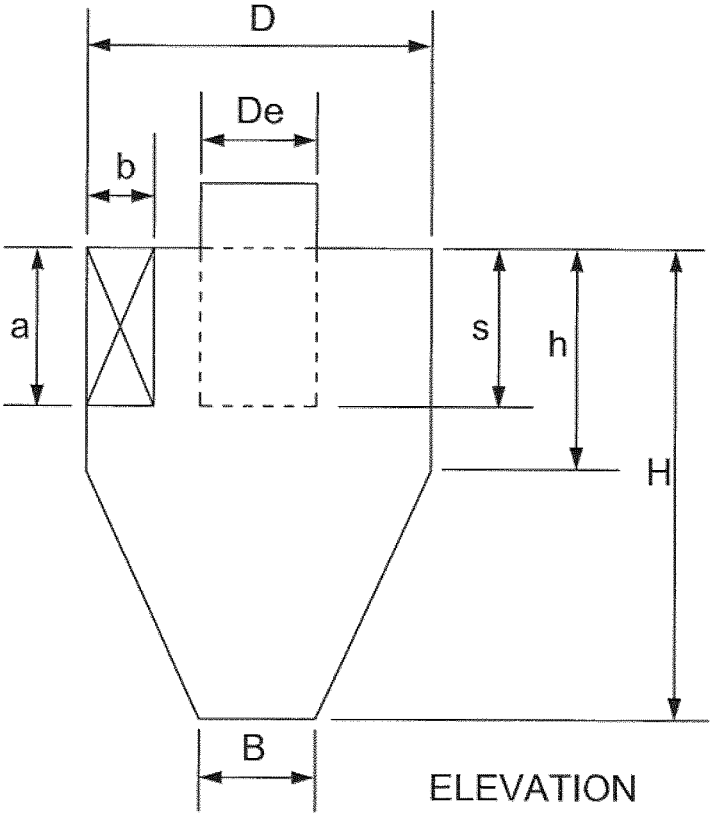
FIG. 23 is a schematic diagram of an engineered cyclone separator useful in the methods and systems of this disclosure.

FIG. 20 is a schematic perspective view, with portions cut away, of a truck-mounted system embodiment 600 in accordance with the present disclosure. Embodiment 600 includes a first truck trailer 602 carrying first and second thermal extraction units with accompanying TEBs 14A, 14B, and respective motor/drive units 16A, 16B, and gear boxes 17A, 17B. Exhaust vents are illustrated at 12A, 12B, where small diameter stacks will be added during operation. The feed pump is actually at the bottom of TEBs 14A, 14B and feed to the TEBs occurs from the side via the connecting piece 13 between TEBs 14A, 14B at the feed end, and each thermal extraction unit has a primary cyclone 54A, 54B, feeding a single secondary cyclone 56. A solids discharge bin 606 may be provided. A control panel 604 may be installed as illustrated. A second truck trailer 610 may carry electric generator 28, oil water separator 82, and a control room 612, as well as a fin fan cooler 98. A separate oil tanker truck 608 may be provided in system embodiment 600, for providing a source of fuel oil for electric generator 28, or for collecting oil recovered by the method and system of embodiment 600. Those of skill will surely have the ability to envision other truck-mounted arrangements, as well as skid-mounted, rig-mounted, and vessel-mounted systems, which nevertheless are considered within the present disclosure.

FIGS. 21A, 21B, 22A, 22B, and 22C are logic diagrams of two methods in accordance with the present disclosure. Method embodiment 700 comprises feeding a feed composition comprising inert solids, liquid hydrocarbons and liquid water to a thermal extraction unit comprising an external casing defining an internal chamber in which first and second intermeshing screws rotate at the same speed, the screws each comprising a shaft and a plurality of screw elements, the screw elements on the first screw configured to be in close tolerance to adjacent screw elements on the second screw, and all screw elements in close tolerance with inside surfaces of the casing, and wherein portions of the casing, shafts and screw elements define a tortuous flow path in which the feed composition and a substantially vaporous composition evolved therefrom flow, the substantially vaporous composition comprising co-mingled hydrocarbon vapors, water vapor, and fine particles of the inert solids, box 702. In some cases, the feed composition includes dissolved solids, in which cases the substantially vaporous composition can include fine particles of dehydrated dissolved solids.

Method embodiment 700 further comprises reducing pressure while increasing temperature in the thermal extraction chamber as the plurality of intermeshing screw elements push the feed composition toward a discharge end of the thermal extraction chamber at a first velocity, while rotating the screws at a speed sufficient, in combination with geometry of the screws and casing, to create turbulent vacuum thermal conditions in the thermal extraction chamber sufficient to physically transform some or all of the feed composition into the substantially vaporous composition, and optionally forming a heated, substantially dry, depleted feed composition comprising non-fine particles of the inert solids, the substantially vaporous composition traversing the tortuous flow path with a second velocity at least 1.5 times the first velocity, box 704. When the feed composition includes dissolved solids, the heated, substantially dry, depleted feed composition can further comprise non-fine particles of dehydrated dissolved solids.

Method embodiment 700 further comprises flowing a motive fluid through one or more eductors to produce the reduced pressure, and condensing substantially all of the hydrocarbons and water volatilized from the composition using the motive water, forming a liquid hydrocarbon/water mixture, box 706.

Method embodiment 700 further comprises separating the hydrocarbons from the water in the hydrocarbon/water mixture using a hydrocarbon/water separator, box 708.

Method embodiment 700 further comprises optionally combining at least some of the water used in the eductors with the heated, substantially dry depleted feed composition comprising non-fine particles of the inert solids composition discharged from the thermal extraction unit to form a rehydrated inert solids composition, box 710.

Method embodiment 800 comprises continuously feeding a composition comprising 1) inert solids having a maximum diameter of 10 micrometers, 2) liquid hydrocarbons and 3) liquid water inert solids, liquid hydrocarbons and liquid water to a thermal extraction unit comprising an external casing defining an internal thermal extraction chamber in which first and second intermeshing screws rotate at the same speed ranging from about 20 to about 200 rpm, the screws each comprising a shaft and a plurality of screw elements, the screw elements on the first screw configured to be in close tolerance to adjacent screw elements on the second screw, and all screw elements in close tolerance with inside surfaces of the casing, and wherein portions of the casing, shafts and screw elements define a tortuous flow path in which the feed composition and a substantially vaporous composition evolved therefrom flow in plug flow, the substantially vaporous composition comprising co-mingled hydrocarbon vapors, water vapor, and fine particles of the inert solids, box 802.

Method embodiment 800 further comprises reducing pressure while increasing temperature in the thermal extraction chamber as the plurality of intermeshing screw elements continuously push the feed composition toward a discharge end of the thermal extraction chamber at a first velocity, while rotating the screws at a speed sufficient, in combination with geometry of the screws and casing, to create turbulent vacuum thermal conditions in the thermal extraction chamber sufficient to continuously physically transform some or all of the feed composition into the substantially vaporous composition, and optionally continuously forming a heated, substantially dry, depleted feed composition comprising non-fine particles of the inert solids, the substantially vaporous composition traversing the tortuous flow path with a second velocity at least 3 times the first velocity, box 804.

Method embodiment 800 further comprises flowing a motive fluid through one or more eductors to produce the reduced pressure, and condensing substantially all of the hydrocarbons and water volatilized from the composition using the motive water, forming a liquid hydrocarbon/water mixture, box 806.

Method embodiment 800 further comprise separating the hydrocarbons from the water in the hydrocarbon/water mixture using a hydrocarbon/water separator, box 808, combining at least some of the water used in the eductors with the heated, substantially dry depleted feed composition comprising non-fine particles of the inert solids discharged from the thermal extraction unit to form a rehydrated inert solids composition, box 810, and operating an electrical power generator by combusting a fuel with an oxidant, creating hot combustion gases, and using at least a portion of the hot combustion gases to increase the temperature of the chamber, box 812.

Method embodiment 800 then comprises selecting, box 814, a system with or without a physically separate solids cooling/rehydrating unit. If no, method embodiment 800 further comprises cooling the rehydrated inert solids using a cooling section attached directly to the thermal extraction unit through a seal section, box 816, and then powering the screws of the thermal extraction unit and the cooling section with the electrical power generator. If the system does have a physically separate solids cooling/rehydrating unit, method embodiment 800 further comprises cooling the rehydrated inert solids in the physically separate cooling/rehydration unit, box 820, powering the screws of the thermal extraction unit and the physically separate cooling/rehydration unit with the electrical power generator.

The feed composition in one embodiment comprises from about 4 to about 60 weight percent inert solids, from about 5 to about 75 weight percent water, and from about 5 to about 70 weight percent hydrocarbons. In another embodiment, the feed composition comprises from about 0 to about 67 weight percent inert solids, from about 31 to about 97 weight percent water, and from about 2 to about 25 weight percent hydrocarbons. In yet another embodiment, the feed composition comprises from about 0 to about 90 percent inert solids, from about 0 to about 97 weight percent water, and from 0 to about 95 weight percent hydrocarbons.

EXAMPLES

A series of tests were conducted using the pilot unit described herein to process a number of slurry feed compositions. Tests were conducted using both water, oil and oil/water based slurries. The solid particles included various clays including bentonite, barite, and calcium carbonate. Other organic chemicals were added to the slurry to ensure the solids remained suspended and thoroughly homogenized and stable, i.e. no separation, throughout the tests. Most slurries were non-Newtonian fluids. Table 3 lists the oil/water/solids content of slurries that were tested and for which a complete mass and energy balance was calculated. The slurries were successfully processed into dry solids comprising less than 1 dry weight percent oil content resulting in significant volume reduction. The recovered oil was of very high quality, which required no additional filtering or processing or treatment. The recovered water was also of very high quality and required only a simple oil/water separator which was suitable for rehydration without significantly impacting the oil content in the dry solids. An optional trace activated carbon filter could be utilized depending upon the final disposition of the recovered water.

TABLE 3

Example Slurries and Mass Balance

| Slurry Composition & Properties | Test 1 | Test 2 | Test 3 | Test 4 | Test 5 |
|---|---|---|---|---|---|
| Hydrocarbons wt % | 33% | 32% | 31% | 52% | 24% |
| Water wt % | 36% | 9% | 51% | 31% | 71% |
| Solids wt % | 31% | 59% | 18% | 17% | 4% |
| Density kg/L | 1.28 | 1.56 | 1.12 | 1.00 | 0.98 |
| Specific Energy of Consumption kW hr/kg | 0.421 | 0.250 | 0.440 | 0.436 | 0.617 |
| Throughput kg/hr | 25.2 | 46.0 | 17.6 | 19.0 | 13.2 |
| Power In (Heaters & Drive Motor) kW | 10.62 | 47.20 | 17.16 | 19.96 | 10.88 |
| Energy Efficiency | 100% | 97% | 82% | 76% | 75% |
| Hydrocarbon Recovered kg | 11.14 | 7.6 | 9.4 | 9.2 | 4.6 |
| Hydrocarbon Recovery Efficiency | 98% | 95% | 94% | 90% | 96% |
| Residual Hydrocarbon on Solids % dry wt | <1% | <1% | <1% | <2% | <1% |

For a majority of the tests and for all oil-based slurries, a peristaltic pump was used to feed the material. The peristaltic pump provided sufficient seal to maintain vacuum in the TEB and a controlled steady feed.

Successful testing was conducted using 7×110 mm casing sections of which one was used for feeding and the other six were used for heating. (Refer to FIG. 14). Heat was generated via electrical resistance heating using both mica and ceramic band heaters readily available from multiple suppliers. Ceramic heaters are more advantages by providing higher watt density of 7 W/cm$^2$ and higher operating temperature of up to 650° C. although the maximum external casing temperature was 500° C. and a minimum of 350° C. Also, ceramic heaters can operate for longer periods of time without failing.

In the pilot tests using the TVT process, OBS material was pumped using a peristaltic pump into the TEB at the drive end of the system. The OBS entered a fully intermeshing flight section (feed zone), which acted as a pump to quickly move material into the heated sections of the TEB. As the OBS was conveyed in the TEB, the temperature of the OBS continued to rise in the thermal extraction chamber resulting in significant physical composition changes from slurry to a solid. The thermal extraction chamber used a combination of full and partial intermeshing flights to ensure that material was conveyed without plugging or restrictions along with providing a passage for the vapors generated in the extraction process. Vapors were evacuated under a vacuum ranging from 10-28 inches (25 mm-711 mm) Hg and quenched in the same step via an eductor. Water was used as the motive flow for the eductor, which provided all three processes in a single device: removal, conveyance and condensation of the water and hydrocarbon vapors. This stream contained mostly water, which was transferred by gravity to a simple Oil Water Separator (OWS). The water volume built over time along with the temperature. To control water temperature for the water-condensing loop, a standard fin fan cooler was used. The eductor also carried over a trace quantity of fine particulate. This dirty water and additional recovered water was filtered using standard cartridge and activated carbon filters to remove impurities. The Discharge Solids (DS) exited through the TEB very dry and at elevated temperatures, greater than 275° C. The DS were collected in closed container, however in practice the DS may be rehydrated using the water from the OWS and cooled in the manner described earlier. The cool and rewetted DS may then be safely handled and removed for disposal at a landfill, or recycled in whatever process they were originally used in. In the OWS, the oil was easily be separated by gravity and collected for storage.

The pilot unit had screw shafts with modular screw elements. These elements included various combinations of closely-meshing "FD" screws with thick flights, and free-meshing "FF" screws with thin flights, such as those illustrated and discussed previously in reference to FIGS. 15A, 15B, 15C, and 15D. In methods and systems of the present disclosure, the feed material is a fluid slurry, mostly liquid, which at the end of the process becomes a solid powder. One of the concerns was the potential for solid material build up on the screw flights. At some point in the TEB 14, the OBS material became very sticky and adhered to the screw elements, thereby preventing material transfer to the exit rendering the entire process useless. Therefore, the selection of the screw elements' geometry was critical.

Screw Element Configuration 1—Water-Based Slurry ("WBS"). Initial experiments with the pilot unit were conducted using simple water/clay/barite slurries. This was in part to demonstrate the "worse case" scenario in terms of material build up. As can be seen in the photograph in FIG.

16A, the test indicated significant material build up at roughly 13 inches (33 cm) from the left or inlet end where so much material had adhered to the screw element that it had prevented any subsequent material to advance further, resulting in a premature termination of the test run. During testing, it was discovered that over heating at the initial feed end of the TEB 14 may also lead to rapid drying of the WBS which can lead to plugging. Successful tests were conducted by moving the heaters towards the discharge end of the TEB 14 but feed was intermittent and slow. Monitoring the solids discharge (open into bucket) suggested that the intermittent material discharge was due to material building upon the screw flights and when sufficient amounts were build up, the solid would break off and subsequently force more material to come off the flights downstream. Typical WBS trials used a feed rate of less than 5 kg/hr.

Screw Element Configuration 2—Oil-Based Slurry ("OBS"). In the first two tests with OBS material, the same screw element configuration was used as in WBS, essentially full intermeshing thick flights at the beginning and ending with partially intermeshing thin flights. While the material did feed without issue, there was some material built up on the screw elements, as could be seen in the photographs of FIGS. 16B, 17A, and 17B. It was felt that an alternate screw element configuration could yield improved feed rate.

Screw Element Configuration 3—OBS. In order to further reduce the potential of material build up on the screw elements, an alternate configuration was tested, as illustrated in photograph of FIG. 16C. This configuration #3 consisted of very few thin flight sections based on available screw elements that coincided with the fixed length of barrel sections. Configuration #3 was successful in reducing material build up in the screw elements, as evidenced in the photographs of FIGS. 18A and 18B, however further testing of screw elements may be required. One possible configuration is a complete length consisting of a thick flight full intermeshing screw elements. This configuration was selected for the majority of the tests including those in Table 3.

The collection of solids from the TEB 14 was conducted using three methods: 1) a simple box with a baffle design (Solids Discharge Box) utilizing gravity settling of fine solids; 2) one or more cyclones to efficiently remove fine solids; and 3) an oil scrubber for the removal of ultra fines not captured in the cyclones.

The Solids Discharge Box ("SDB") was moderately effective in the collection of fines, however there was carryover of fines into the condensation system. Significantly, more fines were carried over into the OWS than expected. All fines also floated and would not settle even after days of settling. It is possible that only the smallest particle size distribution did not settle in the SDB which allowed these fines to be suspended with the vapor flow stream to the eductor mouth at relatively high velocities exceeding the settling velocity in the SDB.

Two different cyclone designs were tested. One was a simple conical shaped design with the top diameter of 8 inches (20 cm) that was too large for high collection efficiency. A second engineered cyclone was tested with the dimensions listed in FIG. 23. The engineered cyclone geometry was based on Stairmand High Efficiency design, a commonly used geometry for the removal of ultra fines with a D50 cut point of 2.5 micrometers. A theoretical collection efficiency ("CE") was 84%-92% depending upon inlet velocity and overall flow rate of the solids/oil/steam vapor. The successful testing utilized two cyclones in series generating a CE % ranging from 60%-95% with average of 85%. Particle size distribution of the fines in the feed slurry and the cyclone outlet overflow were measured. Testing indicated that 85% of the solids were collected and those solids that were not collected were 50% less than 2.5 micrometers.

The third method of fines collection utilized an Ultra Fines Scrubber ("UFS") design, as previously discussed in relation to FIG. 19. The UUFS removed the remaining fines of 15% of solids loading into the cyclones. The fines that carried over to the UFS were mostly ultra fines: D50 2.5 micrometers that were not captured by the dual inline cyclones. The UFS operates on the principal of coating the fines with the spray of hot oil allowing for the coalescing of the solids in the hot oil. The fines and vapors entered the UFS and were immediately sprayed with hot oil with a temperature ranging from about 120° C. to about 180° C. in a contact vessel 70 (FIG. 19). The majority of the hydrocarbon vapors and none of the steam were not condensed in contact vessel 70 due to the temperature of the hot oil and limited contact time. The solids laden oil was allowed to settle in the UFS and as some hydrocarbon vapors condensed over time, the settled sludge was transferred directly to the thermal extraction unit 2 (FIG. 1) through conduit 76 for reprocessing. For the pilot testing, this sludge was not returned to the feed as it was measured for mass balance purposes, however it was eventually mixed with other OBS and processed.

Contact vessel 70 consisted of a simple metallic cylinder that was packed with glass spherical media 270 that ranged from about 0.05 to about 0.5 diameter of contact vessel 70. The spherical media could be made of any inert material such as glass, ceramic or stainless steel. The cylindrical contact vessel should have an L/D (height/diameter) ratio ranging from about 8 to about 16. The overall volume of contact vessel 70 should be such that the empty bed residence time of the vapors is between about 0.02 to about 0.1 seconds. The scrubber oil circulation should be proportional to the vapor flow rate between the ratio of 100 to about 500. The UFS operates in a vacuum environment, up to 720 mm Hg. As a result, the hot oil circulating pump 72 (FIG. 19) must overcome this vacuum and deliver the hot oil at a pressure of greater than about 35 kilopascal hence the type and design of the pump is critical. The pump needs to be self-priming, positive displacement, possibly a roller pump, cast-iron construction for high temperature use up to 200° C. A non-clogging Teflon® roller design is a pulseless flow that can pass some particulates. The vacuum created by such a pump ranges from about 300 to about 450 mm Hg, therefore in order to create up to 711 mm Hg the UFS must be raised physically above pump 72 from about 200 to about 400 mm to provide the net positive suction head to overcome the vacuum conditions in the UFS.

Tests were successfully conducted using a contact vessel 70 diameter of 38 mm with an L/D ratio of 13 resulting in an empty bed contact time of 0.05 while using a 12 mm glass spherical packed media. The flow of oil to the scrubber was typically 3 liters per minute or a vapor to scrubber oil ratio of ranging from about 200 to about 400. The pump used was a ½ inch (1.3 cm) Shurflo Model NR-5, creating a suction lift of 382 mm Hg. The UFS was raised 250 mm in height creating a net positive suction head of approximately 630 mm Hg with an output 130 kPa.

Vapor Quench and Vacuum. A reduced pressure or vacuum is applied to TEB 14 to evacuate the desorbed vapors (steam and hydrocarbon vapors) by utilizing an eductor. Eductors operate on the basic principles of flow dynamics. This involves taking a high-pressure motive stream (circulating cooled water for example) and accelerating it through a tapered nozzle to increase the velocity of the fluid. This fluid is then carried on through a diverging secondary chamber where a vacuum is generated in the cavity around the nozzle. The vacuum draws the vapors (mixture of steam and hydrocarbon vapors) into the diverging chamber where the vapors are quickly condensed. These liquid fluids are discharged from the eductor into the oil/water separator.

There are numerous benefits of using an eductor for this application: 1) no moving parts, no seals, no shafts, no packing, no or little maintenance—a distinct advantage over mechanical vacuum pumps; 2) can create a low vacuum up to 29 inches (740 mm) Hg resulting in lower boiling points for the feed hydrocarbons; 3) operates at high temps; 4) motive fluid provides condensing, transport mechanism and vacuum; 5) desired vacuum may be easily controlled with motive flow rate and pressure; and 6) simple and cost effective.

Lowering the operating pressure, similar to vacuum distillation, reduces the boiling point (reduces vapor pressure) of the hydrocarbons and water in the feed and provides several benefits such as: lower equipment operating temperatures; lower energy costs; lower cooling costs; reduced cracking of hydrocarbons; reduced fugitive non-condensable gases; allows for more broad material and equipment selection; allows for treatment of very high boiling point compounds which are untreatable with other technologies and lower maintenance costs. The relationship between boiling point of hydrocarbons and vacuum pressure is well-known. During the pilot testing, the operating pressure in chamber 15 was between 381 mm-660 mm Hg vacuum, therefore resulting in a reduction in boiling point from 317° C. down to as much as 230° C., a 27% reduction for C18 hydrocarbon. Some tests exceeded 711 mm Hg.

The eductor used in the TVT pilot unit was a Model ML 1.5 inch (3.8 cm). Motive pressure was typically 310 kPa during testing.

Alternatively, a traditional quench tower design consisting of an open vessel in which liquid (usually circulating water) is sprayed to contact the desorbed vapors. The vapors typically enter the bottom of the tower through a side nozzle and flow upwards, counter-current to liquid that has been sprayed from the top of the tower. By the time the vapor reach the top, it has been cooled to its adiabatic saturation temperature and condensed. Since no vacuum is created with a quench tower, a small blower will be required at the gas outlet to ensure a small vacuum for the continuous flow of vapors through the quench tower.

In order to ensure vapors flow through the quenching process to the exit and all non-condensable hydrocarbons from cracking in the TEB are removed, a regenerative blower or positive displacement blower may be used in a multi-step condensation process. Multi-step condensation allows for the systematic and controlled removal and recovery of fines, hydrocarbons and water from the vapor stream from the desorption process.

Oil Water Separation. A simple oil water separator (OWS) was designed and implemented for the TVT pilot unit tests. The OWS was designed to separate gross amounts of oil using gravity separation. The design was based on the specific gravity difference between the oil and the circulating water. Prior to the OWS, the desorbed vapors were completely condensed in the eductor and the discharge pipe by the relatively large circulating water acting as the motive flow for the eductor. The amount of water required for condensing was significantly less than the water required for the efficient operation of the eductor, therefore the water flow rate was determined by the motive flow of the eductor. For example, in the pilot testing a typical OBS feed composition required 7 kW of cooling to condense the vapors. This resulted in less than 4 liters per minute (lpm) of quench water required to fully condense the water and hydrocarbon vapors, which was significantly less than 75 lpm required by the eductor setup. Clearly there was more than sufficient quench water available. The quench water pump may be a simple centrifugal pump delivering 275 kPa or greater pressure at a flow rate determined by the eductor.

The capacity of the OWS should be sized for a complete vessel turnover taking about 2 to about 10 minutes. Successful tests using the TVT pilot unit's quench water pump at 75 L/m at a pressure of 275 kPa and OWS had a capacity of 0.33 $m^3$ providing 4.4 minutes of residence time. The OWS was a simple open vessel with perforated baffles to minimize short circuiting and to reduce water velocity through the OWS.

Oxidant, fuels, and other fluids may be supplied from one or more supply tanks or containers which are fluidly and mechanically connected to the systems as described herein via one or more conduits, which may or may not include flow control valves. One or more of the conduits may be flexible metal hoses, but they may also be solid metal, ceramic, or ceramic-lined metal conduits. Any or all of the conduits may include a flow control valve, which may be adjusted to shut off flow through a particular conduit. Those of skill in this art will readily understand the need for, and be able to construct suitable fuel supply conduits and oxidant supply conduits, as well as respective flow control valves, threaded fittings, quick connect/disconnect fittings, hose fittings, and the like.

In systems and methods employing a feeder, one or more hoppers containing one or more OBS may be provided. While it is contemplated that OBS will flow merely by gravity from the hoppers, and the hoppers need not have a pressure above the solids level, certain embodiments may include a pressurized headspace above the hoppers. Various screw-feeder embodiments may be used, and feed material compaction may be useful. One or more of the hoppers may include shakers or other apparatus common in industry to dislodge overly compacted solids and keep the particles flowing. Furthermore, each hopper may have a valve other apparatus to stop or adjust flow of particulate matter into the downstream apparatus. Certain systems and methods may make use of one or more "side entry screws" or "pusher screws" positioned substantially perpendicularly to TEB 14 to feed some of the feed material into TEB 14, and provide an additional vent for steam and/or hydrocarbon vapors. These details are not illustrated for sake of brevity.

Certain systems and methods of the present disclosure may be combined with other separation strategies. For example, one or more centrifuges may be employed upstream of the systems of the present disclosure to remove large (non-fine) particles. These may be present on-site, or be trucked in separately.

The solids exit of the thermal extraction unit may include, or direct rehydrated solids to, one or more end uses, for example when the solids contain metal-forming materials, they might be used as feed to metal melting units for producing a variety of metal end products, such as wire or cable.

The flow rate of the OBS in the thermal extraction unit will depend on many factors, including the geometry and size of the TEB and associated apparatus, temperature of the OBS, viscosity of the OBS, and like parameters, but in general the flow rate of OBS into the TEB may range from about 0.1 kg/min to about 100 kg/min or more, or from about 10 kg/min to about 80 kg/min.

In certain embodiments, solids cooling sections or units may include refractory fluid-cooled panels. Liquid-cooled panels may be used, having one or more conduits or tubing therein, supplied with liquid through one conduit, with another conduit discharging warmed liquid, routing heat transferred from inside the unit to the liquid away from the unit. Liquid-cooled panels may also include a thin refractory liner. Other useful cooled panels include air-cooled panels, comprising a conduit that has a first, small diameter section, and a large diameter section. Warmed air transverses the conduits such that the conduit having the larger diameter accommodates expansion of the air as it is warmed. Air-cooled panels are described more fully in U.S. Pat. No. 6,244,197. In certain embodiments, the refractory fluid cooled-panels may be cooled by a heat transfer fluid selected from the group consisting of gaseous, liquid, or combinations of gaseous and liquid compositions that functions or is capable of being modified to function as a heat transfer fluid. Gaseous heat transfer fluids may be selected from air, including ambient air and treated air (for air treated to remove moisture), inert inorganic gases, such as nitrogen, argon, and helium, inert organic gases such as fluoro-, chloro- and chlorofluorocarbons, including perfluorinated versions, such as tetrafluoromethane, and hexafluoroethane, and tetrafluoroethylene, and the like, and mixtures of inert gases with small portions of non-inert gases, such as hydrogen. Heat transfer liquids may be selected from inert liquids that may be organic, inorganic, or some combination thereof, for example, salt solutions, glycol solutions, oils and the like. Other possible heat transfer fluids include steam (if cooler than the item to be cooled), carbon dioxide, or mixtures thereof with nitrogen. Heat transfer fluids may be compositions comprising both gas and liquid phases, such as the higher chlorofluorocarbons.

In certain systems and methods of the present disclosure, feed rate, heat input, degree of pressure reduction or vacuum, and degree of turbulence may be adjusted. Adjustment may be via automatic, semi-automatic, or manual control. Certain embodiments may comprise a control scheme for the thermal extraction unit, vacuum systems, hydrocarbon/water separators, solids rehydration units, generators, and the like. For example, a master controller may be configured to provide any number of control logics, including feedback control, feed-forward control, cascade control, and the like, in association with one or more slave controllers. The disclosure is not limited to a single master controller, as any combination of controllers could be used. The term "control", used as a transitive verb, means to verify or regulate by comparing with a standard or desired value. Control may be closed-loop, feedback, feed-forward, cascade, model predictive, adaptive, heuristic and combinations thereof. The term "controller" means a device at least capable of accepting input from sensors and meters in real time or near—real time, and sending commands directly to one or more control elements, and/or to local devices associated with control elements able to accept commands. A controller may also be capable of accepting input from human operators; accessing databases, such as relational databases; sending data to and accessing data in databases, data warehouses or data marts; and sending information to and accepting input from a display device readable by a human. A controller may also interface with or have integrated therewith one or more software application modules, and may supervise interaction between databases and one or more software application modules. The controller may utilize Model Predictive Control (MPC) or other advanced multivariable control methods used in multiple input/multiple output (MIMO) systems.

Those having ordinary skill in this art will appreciate that there are many possible variations of the systems and methods described herein, and will be able to devise alternatives and improvements to those described herein that are nevertheless considered to be within the claims. For example, the length, diameter, and screw geometries of the thermal extraction unit may vary widely and yet still accomplish many of the goals described herein.

What is claimed is:

1. A method comprising:

feeding a feed composition comprising inert solids, liquid hydrocarbons and liquid water to a thermal extraction unit comprising an external casing defining an internal thermal extraction chamber in which first and second intermeshing screws rotate at the same speed, the first and second intermeshing screws each comprising a shaft and a plurality of screw elements, the plurality of screw elements on the first intermeshing screw configured to be in close tolerance to the plurality of screw elements on the second intermeshing screw adjacent thereto, and all screw elements in close tolerance with inside surfaces of the casing, such that frictional heat is generated when the feed composition passes between the plurality of screw elements on the first intermeshing screw and the plurality of screw elements on the second intermeshing screw, and wherein portions of the casing, the shafts and the plurality of screw elements define a tortuous flow path in which the feed composition and a substantially vaporous composition evolved therefrom flow, at least a portion of the tortuous flow path is non-linear, the substantially vaporous composition comprising co-mingled hydrocarbon vapors, water vapor, and fine particles of the inert solids; and reducing pressure while increasing temperature in the thermal extraction chamber as the plurality of screw elements on the first and second intermeshing screws push the feed composition toward a discharge end of the thermal extraction chamber at a first velocity, while rotating the first and second intermeshing screws at a speed sufficient, in combination with geometry of the first and second intermeshing screws and the casing, to create turbulent vacuum thermal conditions in the thermal extraction chamber sufficient to physically transform some or all of the feed composition into the substantially vaporous composition, and forming a heated, substantially dry, depleted feed composition comprising non-fine particles of the inert solids, the substantially vaporous composition traversing the tortuous flow path with a second velocity at least 1.5 times the first velocity.

2. The method of claim 1 performed continuously.

3. The method of claim 1 comprising flowing a motive fluid through one or more eductors to produce the reduced pressure.

4. The method of claim 3 wherein the motive fluid is selected from the group consisting of water, oil, and combinations thereof.

5. The method of claim 4 comprising condensing substantially all of the hydrocarbon vapors and substantially all of the water vapor volatilized from the feed composition using the motive fluid, forming a liquid hydrocarbon/water mixture.

6. The method of claim 1 comprising separating substantially all remaining inert solids from the substantially vaporous composition using a separator selected from the group consisting of one or more cyclone separators, one or more scrubbers comprising packed media, and combinations thereof.

7. The method of claim 1 comprising reducing pressure in the thermal extraction chamber below atmospheric pressure.

8. The method of claim 1 comprising operating an electrical power generator by combusting a fuel with an oxidant, creating hot combustion gases, and using at least a portion of the hot combustion gases to increase the temperature of the internal thermal extraction chamber.

9. The method of claim 1 comprising rotating each of the first and second intermeshing screws at the same speed, the same speed ranging from about 20 to about 200 rpm.

10. The method of claim 1 comprising cooling the heated, substantially dry depleted feed composition comprising the non-fine particles of the inert solids to form a cooled, substantially dry inert solids composition, and then rehydrating the cooled substantially dry inert solids composition by combining the cooled substantially dry inert solids composition with water, wherein the cooling and the rehydrating are performed in a unit selected from a unit attached directly to the thermal extraction unit through a seal section, and a unit physically separate from the thermal extraction unit.

11. The method of claim 1 wherein the feed composition comprises an emulsion selected from the group consisting of oil-in-water emulsions, water-in-oil emulsions, and complex emulsions.

12. The method of claim 1 wherein the feed composition further comprises dissolved solids, and the substantially vaporous composition further comprises dehydrated fine particles of the dissolved solids, and the heated, substantially dry, depleted feed composition comprising non-fine particles of the inert solids further comprises non-fine particles of the dehydrated dissolved solids.

13. A method comprising:

feeding a feed composition comprising inert solids, liquid hydrocarbons and liquid water to a thermal extraction unit comprising an external casing defining an internal thermal extraction chamber in which first and second intermeshing screws rotate at the same speed ranging from about 20 to about 200 rpm, the first and second intermeshing screws each comprising a shaft and a plurality of screw elements, the plurality of screw elements on the first intermeshing screw configured to be in close tolerance to the plurality of screw elements on the second intermeshing screw adjacent thereto, and all of the plurality of screw elements on the first and second intermeshing screws in close tolerance with inside surfaces of the external casing, such that frictional heat is generated when the feed composition passes between the plurality of screw elements on the first intermeshing screw and the plurality of screw elements on the second intermeshing screw, and wherein portions of the casing, the shafts and the screw elements define a tortuous flow path in which the feed composition and a substantially vaporous composition evolved therefrom flow in plug flow, at least a portion of the tortuous flow path is non-linear, the substantially vaporous composition comprising co-mingled hydrocarbon vapors, water vapor, and fine particles of the inert solids; and reducing pressure while increasing temperature in the thermal extraction chamber as the plurality of screw elements on the first and second intermeshing screws push the feed composition toward a discharge end of the thermal extraction chamber at a first velocity, while rotating the first and second intermeshing screws at a speed sufficient, in combination with geometry of the first and second intermeshing screws and the casing, to create turbulent vacuum thermal conditions in the thermal extraction chamber sufficient to physically transform some or all of the feed composition into the substantially vaporous composition, and forming a heated, substantially dry, depleted feed composition comprising non-fine particles of the inert solids, the substantially vaporous composition traversing the tortuous flow path with a second velocity at least 1.5 times the first velocity.

14. A system comprising:

a thermal extraction unit comprising an external casing defining an internal thermal extraction chamber having a length, a width, and a height;

the casing having one or more feed ports, one or more outlet ports, an internal surface and an external surface, at least portions of the external surface configured to accept heat therethrough to the internal surface and indirectly heat in the thermal extraction chamber a feed composition comprising inert solids, liquid hydrocarbons and liquid water;

the casing configured to contain first and second rotatable intermeshing screws positioned in the thermal extraction chamber, the first and second rotatable intermeshing screws each comprising a shaft and a plurality of screw elements, the plurality of screw elements on the first rotatable intermeshing screw configured to be in close tolerance to the plurality of screw elements on the second rotatable intermeshing screw, and substantially all of the plurality of screw elements in close tolerance with the internal surface of the casing, such that frictional heat is generated when the feed composition passes between the plurality of screw elements on the first rotatable intermeshing screw and the plurality of screw elements on the second rotatable intermeshing screw;

wherein portions of the internal surface of the casing, the shafts and the plurality of screw elements on the first and second rotatable intermeshing screws define a tortuous flow path in which the feed composition and a substantially vaporous composition evolved therefrom flow at a first velocity, at least a portion of the tortuous flow path is non-linear, the substantially vaporous composition comprising co-mingled hydrocarbon vapors, water vapor, and fine particles of the inert solids; and wherein the casing, the shafts, and the plurality of screw elements comprise one or more materials suitable for processing the feed composition via heat, reduced pressure, and turbulence to form the substantially vaporous composition and a heated, substantially dry, depleted feed composition comprising non-fine particles of the inert solids, the substantially vaporous composition traversing the tortuous flow path with a second velocity at least 1.5 times the first velocity.

15. The system of claim 14 comprising one or more eductors to produce the reduced pressure.

16. The system of claim 15 wherein one or more of the eductors employs motive water to produce the reduced pressure.

17. The system of claim 16 wherein the eductor is configured to condense substantially all of the hydrocarbons and water volatilized from the feed composition using the motive water, forming a hydrocarbon/water mixture.

18. The system of claim 14 comprising a unit configured to combine at least some of the liquid water separated from the liquid hydrocarbons with the heated, substantially dry, depleted feed composition comprising non-fine particles of the inert solids discharged from the thermal extraction unit to form a solids composition suitable for land filling.

19. The system of claim 14 comprising a separator configured to separate substantially all remaining inert solids from the substantially vaporous composition, the separator selected from the group consisting of one or more cyclone separators, one or more scrubbers comprising packed media, and combinations thereof.

20. The system of claim 14 comprising an electrical power generator configured to operate by combusting a fuel with an oxidant, creating hot combustion gases, and a conduit for directing at least a portion of the hot combustion gases into contact with the external surface of the casing to increase the temperature of the internal thermal extraction chamber via indirect heat transfer.

21. The system of claim 14 configured so that the heated, substantially dry, depleted feed composition comprising non-fine particles of the inert solids is discharged through one or more of the outlet ports, while the substantially vaporous composition is simultaneously discharged via one or more other outlet ports.

22. The system of claim 14 wherein each of the first and second rotatable intermeshing screws is mechanically connected to a driver configured to rotate the first and second rotatable intermeshing screws at the same speed, the same speed ranging from about 20 to about 200 rpm.

23. The system of claim 14 comprising a combining unit configured to rehydrate the heated, substantially dry, depleted feed composition comprising non-fine particles of the inert solids by combining it with water, and further comprising a cooling unit configured to cool the rehydrated solids, the cooling unit selected from a cooling unit attached directly to the thermal extraction unit through a seal section, and a cooling unit physically separate from the thermal extraction unit configured to combine the discharged heated, substantially dry solids composition with the water and cool the rehydrated solids.

24. The system of claim 23 comprising powering the first and second rotatable intermeshing screws of the thermal extraction unit and the combining unit with the same power source.

25. The system of claim 14 wherein the thermal extraction unit is configured to separate the inert solids from the liquid hydrocarbons and the liquid water in the feed composition, wherein the liquid hydrocarbons and the liquid water comprise an emulsion selected from the group consisting of oil-in-water emulsions and water-in-oil emulsions.

26. The system of claim 14, wherein the thermal extraction unit is configured to separate the inert solids from the liquid hydrocarbons and liquid water, wherein the feed composition further comprises dissolved solids, and the substantially vaporous composition further comprises dehydrated fine particles of the dissolved solids, and the heated, substantially dry, depleted feed composition comprising non-fine particles of the inert solids further comprises non-fine particles of the dehydrated dissolved solids.

27. The system of claim 14 mounted on one or more trucks.

28. A method comprising:

feeding a feed composition comprising inert solids, liquid hydrocarbons and liquid water to a thermal extraction unit comprising an external casing defining an internal thermal extraction chamber in which first and second intermeshing screws rotate at equal speed, the first and second intermeshing screws each comprising a shaft and a plurality of screw elements, the plurality of screw elements on the first intermeshing screw configured to be in close tolerance to the plurality of screw elements on the second intermeshing screw, and all of the plurality of screw elements in close tolerance with inside surfaces of the casing, such that frictional heat is generated when the feed composition passes between the plurality of screw elements on the first intermeshing screw and the plurality of screw elements on the second intermeshing screw, and wherein portions of the casing, the shafts and the plurality of screw elements define a tortuous flow path in which the feed composition and a substantially vaporous composition evolved therefrom flow, at least a portion of the tortuous flow path is non-linear, the substantially vaporous composition comprising co-mingled hydrocarbon vapors, water vapor, and fine particles of the inert solids; and reducing pressure while increasing temperature in the thermal extraction chamber as the plurality of screw elements on the first and second intermeshing screws push the feed composition toward a discharge end of the thermal extraction chamber at a first velocity, while rotating the first and second intermeshing screws at a speed sufficient, in combination with geometry of the first and second intermeshing screws and the casing, to create turbulent vacuum thermal conditions in the thermal extraction chamber sufficient to physically transform some or all of the feed composition into the substantially vaporous composition, the substantially vaporous composition traversing the tortuous flow path with a second velocity at least 1.5 times the first velocity.

29. A system comprising:

a thermal extraction unit comprising an external casing defining an internal thermal extraction chamber having a length, a width, and a height;

the casing having one or more feed ports, one or more outlet ports, an internal surface and an external surface, at least portions of the external surface configured to accept heat therethrough to the internal surface and indirectly heat in the thermal extraction chamber a feed composition comprising inert solids, liquid hydrocarbons and liquid water;

the casing configured to contain first and second rotatable intermeshing screws positioned in the thermal extraction chamber, the first and second rotatable intermeshing screws each comprising a shaft and a plurality of screw elements, the plurality of screw elements on the first rotatable intermeshing screw configured to be in close tolerance to the plurality of screw elements on the second rotatable intermeshing screw adjacent thereto, and substantially all of the plurality of screw elements on the first and second rotatable intermeshing screws in close tolerance with the internal surface of the casing, such that frictional heat is generated when the feed composition passes between the plurality of screw elements on the first rotatable intermeshing screw and the plurality of screw elements on the second rotatable intermeshing screw;

wherein portions of the internal surface of the casing, the shafts and the plurality of screw elements on the first and second rotatable intermeshing screws define a tortuous flow path in which the feed composition and a substantially vaporous composition evolved therefrom flow at a first velocity, at least a portion of the tortuous flow path is non-linear, the substantially vaporous composition comprising co-mingled hydrocarbon vapors, water vapor, and fine particles of the inert solids; and wherein the casing, the shafts, and the plurality of screw elements on the first and second rotatable intermeshing screws comprise one or more materials suitable for processing the feed composition via heat, reduced pressure, and turbulence to form the substantially vaporous composition, the substantially vaporous composition traversing the tortuous flow path with a second velocity at least 1.5 times the first velocity.

* * * * *